US008413984B2

(12) United States Patent
Satoh et al.

(10) Patent No.: US 8,413,984 B2
(45) Date of Patent: Apr. 9, 2013

(54) SHEET CONVEYING APPARATUS, BELT DRIVE APPARATUS, IMAGE READING APPARATUS, AND IMAGE FORMING APPARATUS

(75) Inventors: Osamu Satoh, Kanagawa (JP); Tsutomu Kawase, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 664 days.

(21) Appl. No.: 12/577,933

(22) Filed: Oct. 13, 2009

(65) Prior Publication Data

US 2010/0098471 A1 Apr. 22, 2010

(30) Foreign Application Priority Data

Oct. 16, 2008 (JP) ..... 2008-267770
Nov. 10, 2008 (JP) ..... 2008-287528

(51) Int. Cl.
*B65H 7/02* (2006.01)

(52) U.S. Cl.
USPC ..... 271/265.02; 271/227

(58) Field of Classification Search ..... 271/265.02, 271/259, 227
See application file for complete search history.

(56) References Cited

U.S. PATENT DOCUMENTS 4,506,969 A * 3/1985 Baker ..... 396/568
5,440,979 A * 8/1995 Bonham et al. ..... 101/91
6,515,747 B1 2/2003 Satoh et al.
6,937,830 B2 8/2005 Satoh
7,003,258 B2 2/2006 Adachi et al.
7,110,917 B2 9/2006 Matsuura et al.
7,184,674 B2 2/2007 Satoh et al.
7,203,431 B2 4/2007 Shoji et al.
7,219,888 B2 * 5/2007 Trovinger et al. ..... 271/227
7,327,962 B2 2/2008 Shoji et al.
7,457,550 B2 11/2008 Shoji et al.
7,554,574 B2 6/2009 Shoji et al.
7,992,868 B2 * 8/2011 Tachibana et al. ..... 271/265.02
8,308,158 B2 * 11/2012 Hirota ..... 271/227
2004/0094891 A1 * 5/2004 Trovinger et al. ..... 271/227
2005/0281596 A1 12/2005 Nakagawa et al.
2005/0286916 A1 12/2005 Nakazato et al.
2006/0125176 A1 * 6/2006 Kato ..... 271/258.01
2006/0197038 A1 * 9/2006 Park et al. ..... 250/559.37
2006/0294252 A1 12/2006 Shoji et al.
2007/0258723 A1 11/2007 Nakazato et al.
2008/0068639 A1 3/2008 Satoh et al.
2008/0075476 A1 3/2008 Nakazato et al.
2008/0106747 A1 * 5/2008 Kudo et al. ..... 356/616
2008/0199193 A1 8/2008 Nakazato et al.
2009/0033993 A1 2/2009 Nakazato et al.
2009/0034990 A1 2/2009 Nakazato et al.
2009/0052912 A1 2/2009 Soji et al.
2009/0190939 A1 7/2009 Satoh et al.
2009/0196634 A1 * 8/2009 Satoh et al. ..... 399/16
2011/0063356 A1 * 3/2011 Kobayashi et al. ..... 347/16

FOREIGN PATENT DOCUMENTS

JP 2-127346 5/1990
JP 4-4167 1/1992

(Continued)

*Primary Examiner* — Patrick Cicchino
(74) *Attorney, Agent, or Firm* — Oblon, Spivak, McClelland, Maier & Neustadt, L.L.P.

(57) ABSTRACT

A sheet conveying apparatus includes a conveying path for conveying a sheet, an optical displacement sensor that detects displacement of the sheet, and a calculating unit that calculates a movement index value indicating moving distances of the sheet in a conveying direction and a direction perpendicular thereto based on an output from the optical displacement sensor. The optical displacement sensor includes a plurality of light receiving elements arranged in a matrix array. A row alignment direction and a column alignment direction of the light receiving elements are tilted with respect to the conveying direction.

16 Claims, 21 Drawing Sheets

FOREIGN PATENT DOCUMENTS

| | | |
|---|---|---|
| JP | 3120354 | 10/2000 |
| JP | 2003-162196 | 6/2003 |
| JP | 2005-41623 | 2/2005 |
| JP | 2005-206307 | 8/2005 |
| JP | 2006-131420 | 5/2006 |
| JP | 2006-208381 | 8/2006 |
| JP | 2006-260574 | 9/2006 |
| JP | 2007-254094 | 10/2007 |
| JP | 2007-276982 | 10/2007 |
| JP | 4117855 | 5/2008 |
| JP | 2008-139283 | 6/2008 |

* cited by examiner

SHEET CONVEYING APPARATUS, BELT DRIVE APPARATUS, IMAGE READING APPARATUS, AND IMAGE FORMING APPARATUS

CROSS-REFERENCE TO RELATED APPLICATIONS

The present application claims priority to and incorporates by reference the entire contents of Japanese Patent Application No. 2008-267770 filed in Japan on Oct. 16, 2008 and Japanese Patent Application No. 2008-287528 filed in Japan on Nov. 10, 2008.

BACKGROUND OF THE INVENTION

1. Field of the Invention

The present invention relates to a sheet conveying apparatus that conveys sheet-like members such as a recording sheet and a sheet-like original, and a belt drive apparatus that endlessly moves an endless belt member. The present invention also relates to an image reading apparatus and an image forming apparatus that use the sheet conveying apparatus or the belt drive apparatus.

2. Description of the Related Art

As an image forming apparatus of this type, an image forming apparatus disclosed in Japanese Patent Application Laid-open No. 2005-41623 is known. The image forming apparatus forms an image on a printing paper by a known electrophotographic process, while feeding the printing paper in a paper feed tray to a paper feed path, and conveying the printing paper. An optical displacement sensor that detects the displacement of the printing paper fed out to the paper feed path is provided in the paper feed tray. The optical displacement sensor is widely used in an optical mouse and the like, that is an input device for a personal computer. The optical displacement sensor optically detects two-dimensional displacement of a printing paper, which is an object to be detected. When a paper feed roller that feeds a printing paper from the paper feed tray and a pair of conveying rollers that applies conveying force to a printing paper in the paper feed path are deteriorated, a so-called skew in which the printing paper is not conveyed in an upright position along the conveying direction, but conveyed in a tilted position starts to occur. By detecting the moving distance of the printing paper in the direction perpendicular to the conveying direction caused by the skew with the optical displacement sensor, the life expectancy of the paper feed roller and the pair of conveying rollers can be predicted, whereby the user is prompted to replace the rollers before the rollers are broken.

The optical displacement sensor includes a light emitting element that emits light to the object to be detected, and a plurality of light receiving elements that receives reflection light obtained on the surface of the object to be detected. The light receiving elements, for example, are arranged in a matrix, as shown by reference numerals 900 in FIG. 1. Fine irregularities are present on the surface of the object to be detected. Accordingly, regions where the amount of reflection light is significantly high, and regions where the amount of reflection light is significantly low (hereinafter, the regions are referred to as "characteristic location") are present on the surface of the object to be detected. The optical displacement sensor obtains two-dimensional displacement at the characteristic location, based on the time series variation of the amount of received light, of the light receiving elements arranged in a matrix. For example, the position of a light receiving element 900 that receives more reflection light varies in time series, as shown in arrows in FIG. 1, with the movement of the characteristic location of the object to be detected. Accordingly, two-dimensional displacement along the arrows of the characteristic location can be obtained.

When the present inventors carried out an experiment to detect the amount of skew of a sheet, by mounting a commercially available optical displacement sensor on a paper feed path of a printer testing machine, the inventors have found out that sensitive detection is difficult. More specifically, nearly all the commercially available optical displacement sensors are developed for optical mice. Accordingly, two-dimensional displacement can only be identified in a very narrow area of the surface of the object to be detected. For example, in the example shown in FIG. 1, a detection area is a sheet area corresponding to a matrix of 16×16 pieces of the light receiving elements 900. However, this is just a very small area of the entire area of the sheet. In FIG. 1, if the direction of the arrow Y is the conveying direction of the sheet, the characteristic location of the sheet moves the entire area in the direction of the arrow Y without fail. At this time, if the sheet is skewed, the sheet also moves in the direction of the arrow X, as well as in the direction of the arrow Y. However, the moving distance in the direction of the arrow X is only a small amount, compared to the moving distance in the direction of the arrow Y. Accordingly, even if the characteristic location of the skewed sheet is moved in the direction of the arrow X in the narrow detection area in FIG. 1, the moving distance is as much as a few pixels (few pieces of light receiving elements). In the example in FIG. 1, such a small amount of moving distance of a few pixels in the direction of the arrow X can only be obtained by a unit of pixel, such as one pixel and two pixels. Consequently, it is difficult to sensitively detect the amount of skew.

The problem when the amount of skew of the sheet in the conveying path such as the paper feed path of the image forming apparatus has been described. However, the similar problem occurs, when the amount of skew of an original in a conveying path of an automatic document feeding device of a scanner is to be detected. The similar problem also occurs, when a configuration in which an optical displacement sensor detects the bias amount of a belt member in the width direction is adopted, in a belt drive apparatus that endlessly moves an endless belt member such as an intermediate transfer belt.

SUMMARY OF THE INVENTION

It is an object of the present invention to at least partially solve the problems in the conventional technology.

According to one aspect of the present invention, there is provide a sheet conveying apparatus including: a conveying path that conveys a sheet-like member; an optical displacement sensor that detects displacement of the sheet-like member based on a result obtained by detecting a light emitted from a light emitting element and reflected on a surface of the sheet-like member in the conveying path using a plurality of light receiving elements arranged in a matrix array; and a calculating unit that calculates a movement index value indicating moving distances of the sheet-like member in a conveying direction and in a direction perpendicular to the conveying direction based on an output from the optical displacement sensor. The optical displacement sensor is provided in such a manner that a row alignment direction and a column alignment direction of the light receiving elements in the matrix array are tilted with respect to the conveying direction.

Furthermore, according to another aspect of the present invention, there is provided a belt drive apparatus that includes an endless belt member, a plurality of stretching members that stretches the belt member while supporting from an inside of a loop formed by the endless belt member, and a drive rotation body that is one of the stretching members and drives the belt member. The belt drive apparatus includes: an optical displacement sensor that detects displacement of the belt member based on a result obtained by detecting a light emitted from a light emitting element and reflected on a surface of the belt member using a plurality of light receiving elements arranged in a matrix array; and a calculating unit that calculates a movement index value indicating moving distances of the belt member in a conveying direction and in a direction perpendicular to the conveying direction based on an output from the optical displacement sensor. The optical displacement sensor is provided in such a manner that a row alignment direction and a column alignment direction of the light receiving elements in the matrix array are tilted with respect to the conveying direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments in which the present invention is applied to an electrophotographic copier (hereinafter, simply referred to as "copier") will be described.

Figure 3:
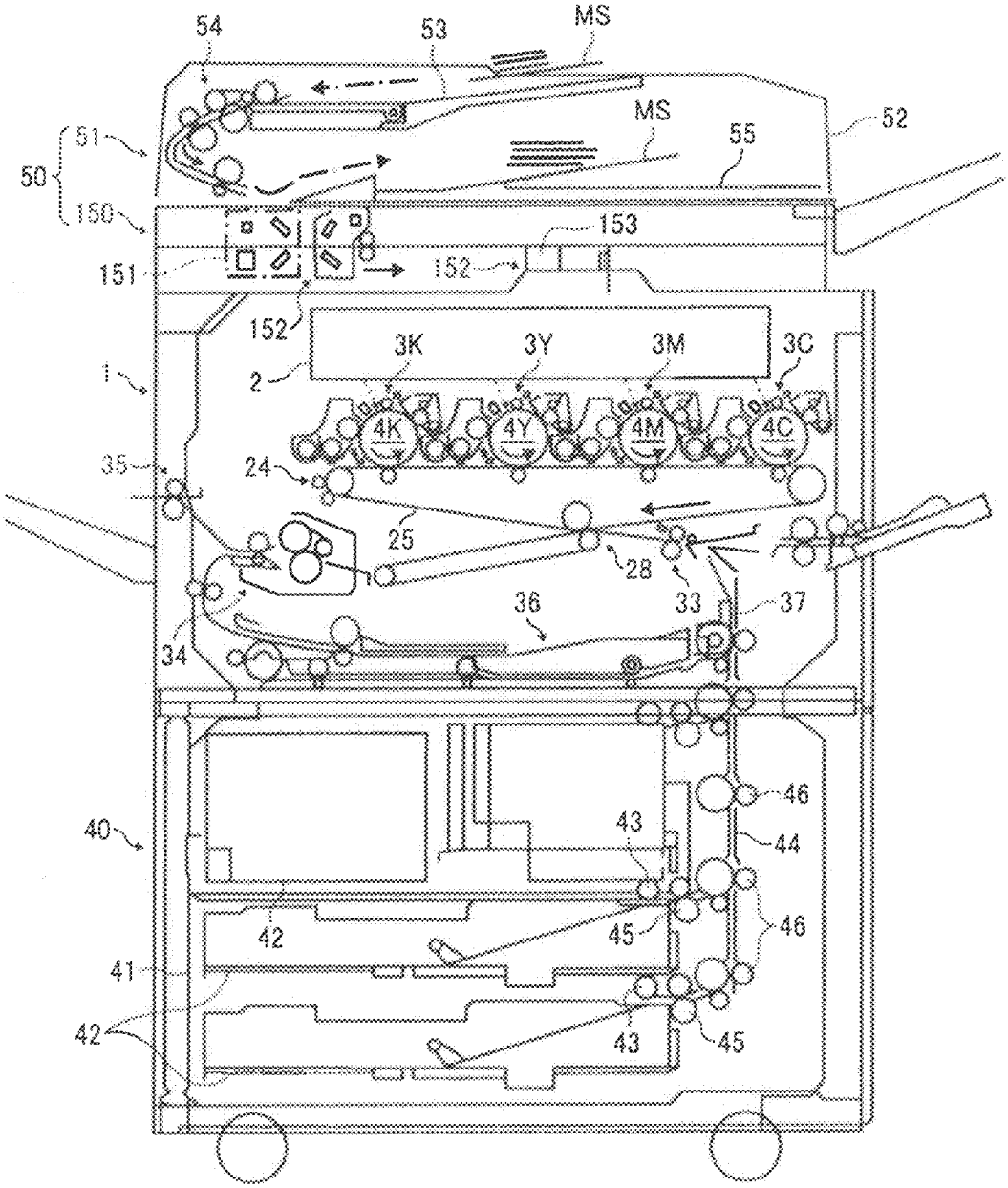
FIG. 3 is a schematic configuration of a copier according to an embodiment of the present invention.

A basic configuration of a copier according to the present embodiment will be described. FIG. 3 is a schematic configuration of the copier according to the embodiment. The copier includes an image forming unit 1 as an image forming apparatus, a white paper supply device 40, and an image reading unit 50. The image reading unit 50 as an image reading apparatus includes a scanner 150 fixed on the image forming unit 1, and an automatic document feeding device (ADF) as a sheet conveying apparatus supported by the scanner 150.

The white paper supply device 40 includes two paper feed cassettes 42 arranged in stages in a paper bank 41, a feeding roller 43 that feeds recording papers from the paper feed cassette, a separation roller 45 that separates the recording papers fed out and supplies to a paper feed path 44, and the like. The white paper supply device 40 also includes a plurality of conveying rollers 46 that conveys each of the recording papers as a sheet-like member, to a paper feed path 37 used as a conveying path for the image forming unit 1, and the like. The recording paper in the paper feed cassette is fed into the paper feed path 37 in the image forming unit 1.

The image forming unit 1 as an image forming unit includes an optical writing device 2, four process units 3 for K, Y, M, and C that form toner images of black, yellow, magenta, and cyan (K, Y, M, and C), a transfer unit 24, a paper conveying unit 28, a pair of registration rollers 33, a fixing device 34, a switch-back device 36, the paper feed path 37, and the like. By driving a light source such as laser diode and LED, which are not shown, arranged in the optical writing device 2, laser light L is emitted to four drum-shaped photosensitive bodies 4 for K, Y, M, and C. By emitting the laser light L, electrostatic latent images are formed on the surfaces of the photosensitive bodies 4 for K, Y, M, and C. Each of the electrostatic latent images is developed into a toner image through a predetermined developing process.

Figure 4:
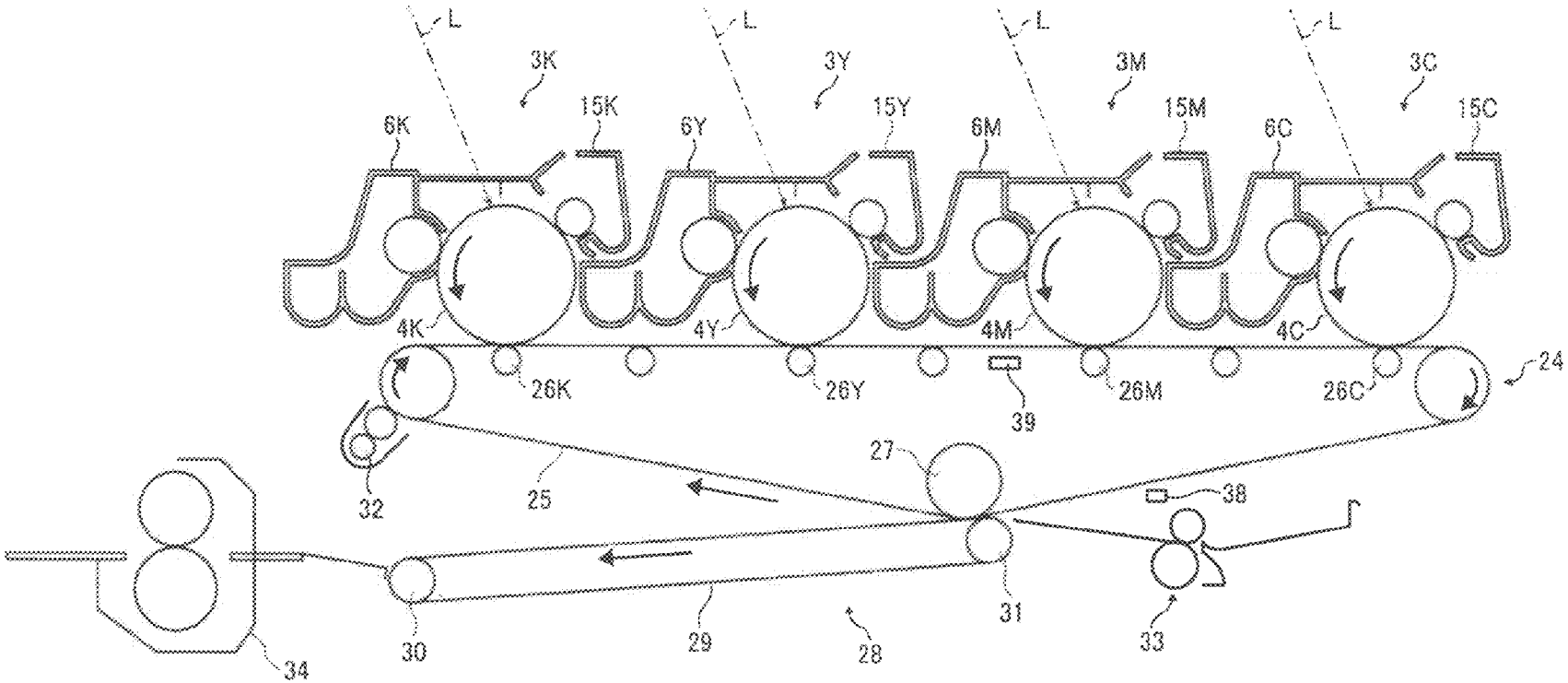
FIG. 4 is an enlarged partial schematic of a part of an image forming unit according to the copier.
Figure 5:
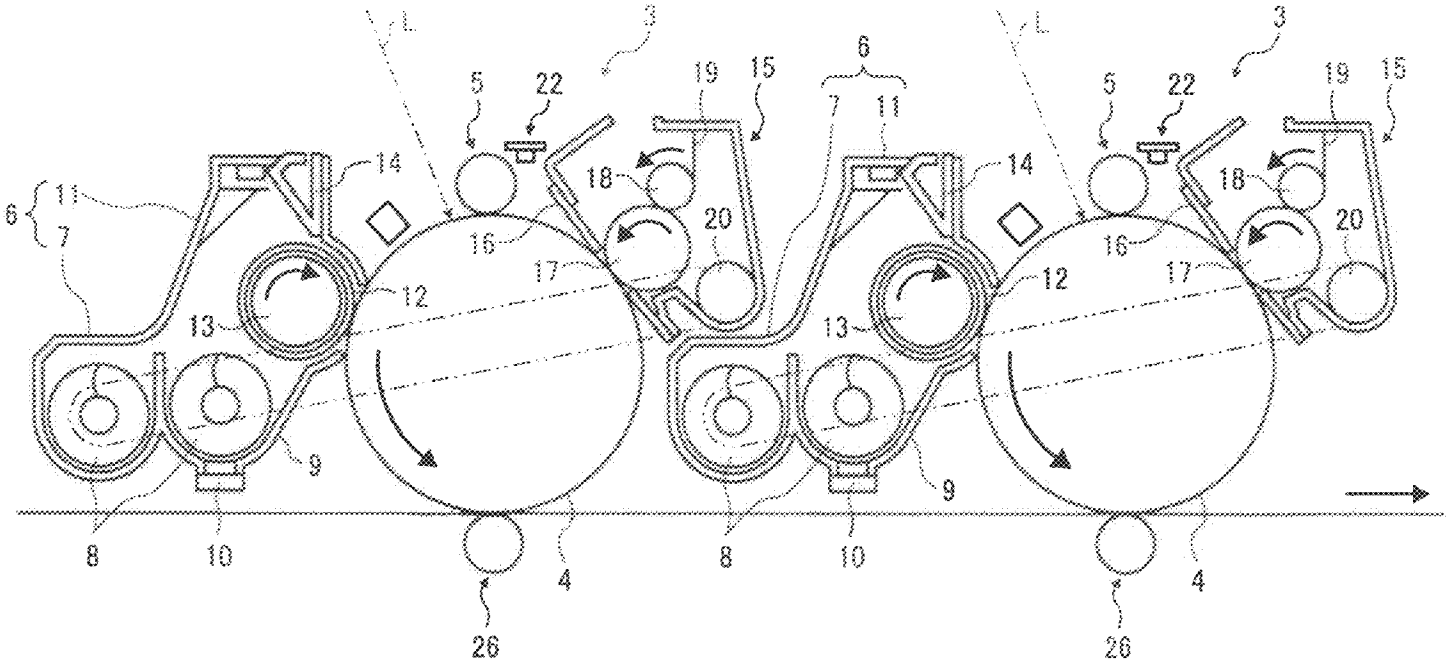
FIG. 5 is a partially enlarged view of a part of a tandem unit including four process units according to the image forming unit.

FIG. 4 is an enlarged partial schematic of a part of an internal configuration of the image forming unit 1. FIG. 5 is a partially enlarged view of a part of a tandem unit including four process units 3 for K, Y, M, and C. Because the four process units 3 for K, Y, M, and C have the same configurations except that the colors of toners to be used are different, the letters K, Y, M, and C appended to the reference numerals are omitted in FIG. 5.

Each of the process units 3 for K, Y, M, and C is supported on a common support body as one unit, including a photosensitive body and various devices arranged at the periphery of the photosensitive body, and the process unit is detachably attached to a main body of the image forming unit 1. Taking a process unit 3K for black as an example, the process unit 3K includes a charger 23, a developing device 6, a drum cleaning device 15, a neutralizing lamp 22, and the like around the photosensitive body 4. The present copier has a so-called tandem configuration, in which the four process units 3 for K, Y, M, and C are arranged opposite to an intermediate transfer belt 25, which will be described later, along the endless moving direction.

The photosensitive body 4 is a drum-shape, and is a photosensitive layer formed by coating an organic photosensitive material having photosensitivity over a blank tube made of aluminum and the like. However, the photosensitive body 4 may have an endless belt-shape.

The developing device 6 develops a latent image by using a two-component developer including a magnetic carrier and a non-magnetic toner, which are not shown. The developing device 6 includes a stirring unit 7 that supplies the two-component developer contained therein to a developing sleeve 12 while stirring and conveying the two-component developer. The developing device 6 also includes a developing unit 11 that transfers the toner in the two-component developer carried by the developing sleeve 12 to the photosensitive body 4.

The stirring unit 7 is provided at a position lower than that of the developing unit 11, and includes two conveying screws 8 arranged in parallel with each other, a partition plate provided between the screws, a toner concentration sensor 10 provided at a bottom surface of a developing case 9, and the like.

The developing unit 11 includes the developing sleeve 12 disposed opposite to the photosensitive body 4 through an opening of the developing case 9, a magnet roller 13 non-rotatably provided in the developing sleeve 12, a doctor blade 14 whose leading edge is brought close to the developing sleeve 12, and the like. The developing sleeve 12 is a non-magnetic rotatable cylinder. The magnet roller 13 has a plurality of magnetic poles sequentially arranged in the rotating direction of the sleeve, from the position opposite to the doctor blade 14. Each of the magnetic poles applies magnetic force to the two-component developer on the sleeve, at a predetermined position in the rotating direction. Accordingly, the two-component developer sent from the stirring unit 7 is drawn to the surface of the developing sleeve 12 and carried thereon, and a magnetic brush is formed on the surface of the sleeve along a magnetic line.

The magnetic brush is conveyed to a developing region opposite to the photosensitive body 4, after the layer is controlled to an appropriate thickness, while the magnetic brush is passed through the position opposite to the doctor blade 14, with the rotation of the developing sleeve 12. The magnetic brush contributes to development, by transferring the toner on the electrostatic latent image, by a potential difference between a developing bias applied to the developing sleeve 12, and the electrostatic latent image of the photosensitive body 4. The magnetic brush is returned to the inside of the developing unit 11, with the rotation of the developing sleeve 12. After being separated from the surface of the sleeve, resulting in an effect of a repulsive magnetic field formed between the magnetic poles of the magnet roller 13, the magnetic brush is then returned to the inside of the stirring unit 7. In the stirring unit 7, based on the detection result of the toner concentration sensor 10, an appropriate amount of toner is supplied to the two-component developer. Instead of adopting the developing device that uses the two-component developer, a developing device that uses a one-component developer not including a magnetic carrier may be used as the developing device 6.

As the drum cleaning device 15, a drum cleaning device that presses a cleaning blade 16 formed of an elastic body against the photosensitive body 4 is used. However, other drum cleaning device may also be used. To improve cleaning effect, the present embodiment adopts a drum cleaning device in which an outer peripheral surface of a fur brush 17 having contact conductivity is brought in contact with the photosensitive body 4, and the fur brush is rotatably arranged in the arrow direction in FIG. 5. The fur brush 17 also serves a role of scraping lubricant from a solid lubricant, which is not shown, and coating the lubricant on the surface of the photosensitive body 4 while reducing the lubricant to fine powder. An electric field roller 18 that applies bias to the fur brush 17 is rotatably provided in the direction of the arrow in FIG. 5, and a leading edge of a scraper 19 is pressed against the electric field roller 18. The toner adhered on the fur brush 17 is transferred to the electric field roller 18 brought into contact with the fur brush 17 in the counter direction, and to which the bias is applied while rotating. After the toner is scraped from the electric field roller 18 by the scraper 19, the toner is dropped onto a collecting screw 20. The collecting screw 20 conveys the collected toner towards the end of the drum cleaning device 15 in the direction perpendicular to the diagram, and delivers the collected toner to a recycle conveying device 21 at the outside. The recycle conveying device 21 recycles the delivered toner by sending the toner to the developing device 6.

The neutralizing lamp 22 neutralizes the photosensitive body 4 by illuminating light. The surface of the neutralized photosensitive body 4 is uniformly charged by the charger 23, and the optical writing device 2 carries out optical writing on the surface. As the charger 23, a charger that rotates a charge roller to which charge bias is applied while in contact with the photosensitive body 4 is used. A scorotoron charger and the like that charges the photosensitive body 4 without coming in contact with the photosensitive body 4 may also be used.

In the aforementioned FIG. 4, toner images of K, Y, M, and C are formed on the photosensitive bodies 4 for K, Y, M, and C of the four process units 3 for K, Y, M, and C, by the process that has been described.

The transfer unit 24 is arranged at a lower portion of the four process units 3 for K, Y, M, and C. The transfer unit 24 as a belt drive apparatus endlessly moves the intermediate transfer belt 25 stretched by a plurality of rollers, while in contact with the photosensitive bodies 4 for K, Y, M, and C in the clockwise direction in FIG. 4. Accordingly, primary transfer nips for K, Y, M, and C, where the photosensitive bodies 4 for K, Y, M, and C and the intermediate transfer belt 25, which is an endless belt member, come into contact with each other are formed. At regions near the primary transfer nips for K, Y, M, and C, the intermediate transfer belt 25 is pressed against the photosensitive bodies 4 for K, Y, M, and C, by primary transfer rollers 26 for K, Y, M, and C arranged inside the belt loop. A primary transfer bias is applied to each of the primary transfer rollers 26 for K, Y, M, and C, by each power source, which is not shown. Accordingly, a primary transfer electric field for electrostatically moving the toner images on the photosensitive bodies 4 for K, Y, M, and C toward the intermediate transfer belt 25, is formed on each of the primary transfer nips for K, Y, M, and C. With the endless movement in the clockwise direction in FIG. 4, on a front surface of the intermediate transfer belt 25 that sequentially passes through the primary transfer nips for K, Y, M, and C, the toner images are sequentially overlapped and primary transferred at each of the primary transfer nips. Due to the overlapping primary transfer, a toner image obtained by overlapping four color toner images (hereinafter, simply referred to as "four-color toner image") is formed on the front surface of the intermediate transfer belt 25.

At a lower portion of the transfer unit 24 in FIG. 4, the paper conveying unit 28 that stretches and endlessly moves an endless paper conveying belt 29, is formed between a drive roller 30 and a secondary transfer roller 31. The intermediate transfer belt 25 and the paper conveying belt 29 are nipped between the secondary transfer roller 31 of the paper conveying unit 28 and a lower tension roller 27 of the transfer unit 24. Accordingly, a secondary transfer nip where the front surface of the intermediate transfer belt 25 and the front surface of the paper conveying belt 29 come into contact with each other is formed. A secondary transfer bias is applied to the secondary transfer roller 31 by a power source, which is not shown. The lower tension roller 27 of the transfer unit 24 is grounded. Consequently, a secondary transfer electric field is formed at the secondary transfer nip.

At the right side of the secondary transfer nip in FIG. 4, the pair of registration rollers 33 is arranged. A registration roller sensor, which is not shown, is disposed near the entrance of the registration nip of the pair of registration rollers 33. The recording paper P conveyed towards the pair of registration rollers 33 from the white paper supply device, which is not shown, is temporally stopped, after a predetermined period of time from when the leading edge of the recording paper P is detected by the registration roller sensor. Accordingly, the leading edge of the recording paper P is pressed against the registration nip of the pair of registration rollers 33. As a result, the position of the recording paper P is corrected, and synchronization with image formation is prepared. In this manner, the position of the recording paper P is corrected. However, the correction may not be successful. In such an event, the recording paper P is skewed at the downstream of the pair of registration rollers 33.

When the leading edge of the recording paper P is pressed against the registration nip, the pair of registration rollers 33 sends the recording paper P to the secondary transfer nip, by restarting the rotation drive of the roller, at the timing that the recording paper P can be synchronized with the four-color toner image on the intermediate transfer belt 25. In the secondary transfer nip, the four-color toner image on the intermediate transfer belt 25 is collectively secondary transferred on the recording paper, by the influence of the secondary transfer electric field and the nip pressure. Accordingly, a full color image is formed, with the white of the recording paper. The recording paper that has passed through the secondary transfer nip is separated from the intermediate transfer belt 25, and while held onto the front surface of the paper conveying belt 29, conveyed to the fixing device 34 along the endless movement of the paper conveying belt 29. At the exit of the registration nip, an optical displacement sensor 38, whose function will be explained later, is arranged.

On the front surface of the intermediate transfer belt 25 that has passed through the secondary transfer nip, residual toner not transferred onto the recording paper at the secondary transfer nip is attached. The residual toner is scraped and removed by a belt cleaning device in contact with the intermediate transfer belt 25.

The full color image is fixed on the recording paper conveyed to the fixing device 34, by pressure and heat applied in the fixing device 34. The recording paper is then sent to a pair of paper discharging rollers 35 from the fixing device 34, and discharged outside the machine.

In the aforementioned FIG. 3, the switch-back device 36 is arranged below the paper conveying unit 28 and the fixing device 34. Accordingly, the passage of the recording paper to which the image is fixed on one surface, is switched to the side of a recording paper reversing device by a switching nail, and the recording paper is reversed by the recording paper reversing device and proceeds to the secondary transfer nip again. The secondary transfer process and the fixing process of an image are applied on the other side of the recording paper, and the recording paper is then discharged onto a paper discharge tray.

The scanner 150 fixed on the image forming unit 1 and an ADF 51 fixed on the scanner 150 include a fixed reading unit and a mobile reading unit 152. The mobile reading unit 152 is arranged directly below a second contact glass, which is not shown, fixed to an upper wall of the casing of the scanner 150, so as to come into contact with an original MS. The mobile reading unit 152 can move an optical system formed of a light source, a reflection mirror, and the like, in the horizontal direction in FIG. 3. While moving the optical system from the left side to the right side in FIG. 3, light emitted from the light source is reflected on an original, which is not shown, placed on the second contact glass. Then, an image reading sensor 153 fixed to a scanner main body receives the light through a plurality of reflection mirrors.

The fixed reading unit includes a first surface fixed reading unit 151 arranged inside the scanner 150, and a second surface fixed reading unit, which is not shown, arranged inside the ADF 51. The first surface fixed reading unit 151 includes a light source, a reflection mirror, an image reading sensor such as a charge coupled device (CCD), and the like, and arranged directly below a first contact glass, which is not shown, fixed to the upper wall of the casing of the scanner 150, so as to come into contact with the original MS. When the original MS conveyed by the ADF 51, which will be described later, passes through above the first contact glass, light emitted from the light source is sequentially reflected on the surface of the original. Accordingly, the image reading sensor receives the light through the plurality of reflection mirrors. Consequently, the first surface of the original MS is scanned, without moving the optical system formed of the light source, the reflection mirror, and the like. The second surface fixed reading unit scans the second surface of the original MS that has passed through the first surface fixed reading unit 151.

Figure 6:
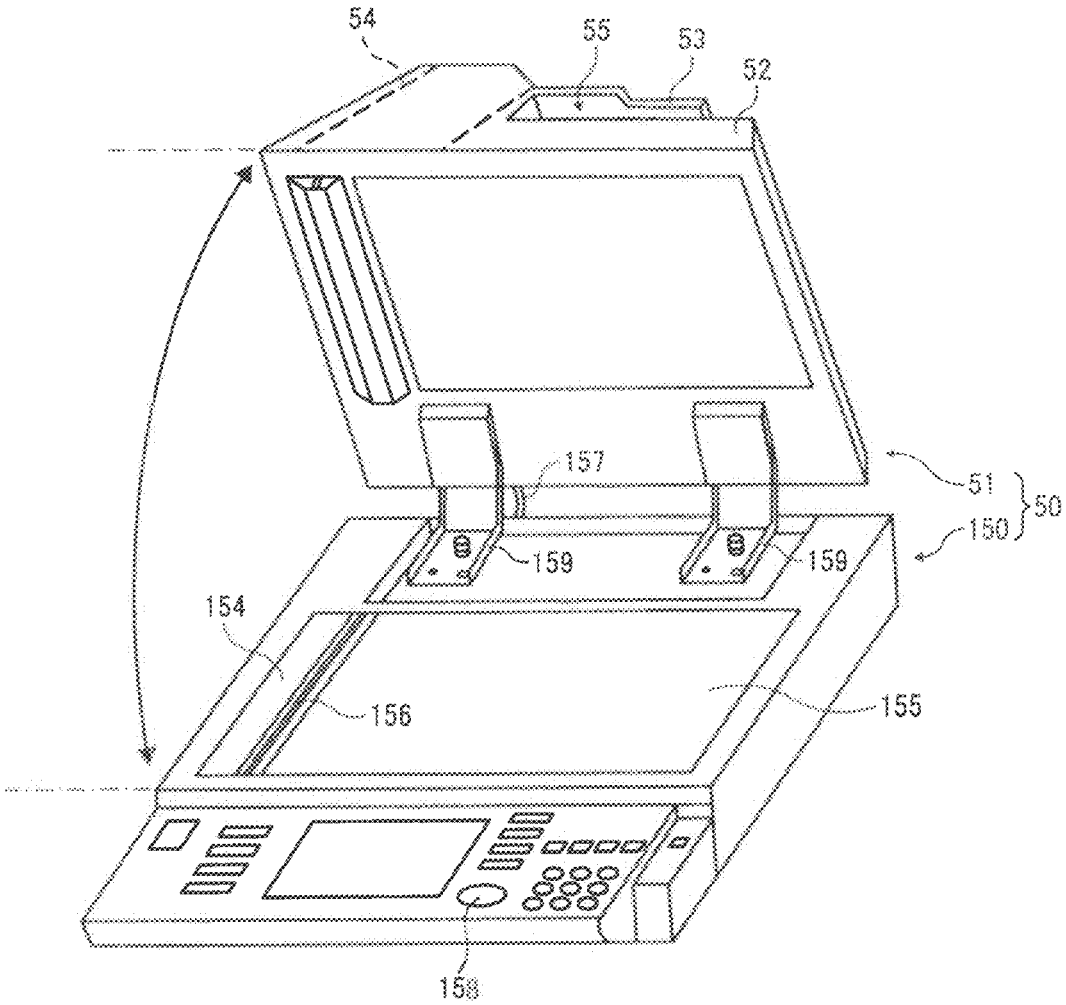
FIG. 6 is a perspective view of a scanner and an ADF of the copier.

The ADF 51 arranged on the scanner 150 includes a platen 53 on which the original MS before being read is placed, a conveying unit 54 for conveying the original MS as a sheet-like member, a stacking platen 55 for stacking the originals MS after being read, and the like, in a main body cover 52. As shown in FIG. 6, hinges 159 fixed to the scanner 150 movably support the ADF 51 in the vertical direction. With the movement, the ADF 51 moves so as to open and close a door, and in the opened state, a first contact glass 154 and a second contact glass 155 at the upper surface of the scanner 150 are exposed. In the event when side-bound originals, such as a book formed by binding the edge of a bundle of originals, are scanned, the originals cannot be separated one by one. Accordingly, the originals cannot be conveyed by the ADF. Consequently, in the event when the side-bound originals are to be scanned, the ADF 51 is opened as shown in FIG. 6, and the side-bound originals whose page desired to be read is opened facing downward, are placed on the second contact glass 155. The ADF is then to be closed. The mobile reading unit 152 of the scanner 150 shown in FIG. 3 reads an image of the page.

Alternatively, in the event of a bundle of originals obtained by simply stacking a plurality of originals MS separated from each other, the ADF 51 automatically conveys each of the originals MS one by one, and the first surface fixed reading unit 151 in the scanner 150 and the second surface fixed reading unit in the ADF 51 sequentially read the original MS. In such an event, a copy start button, which is not shown, is pressed, after the bundle of originals is set on the platen 53. The ADF 51 then sequentially sends each original MS from the bundle of originals placed on the platen 53 from the top into the conveying unit 54, and the original MS is conveyed towards the stacking platen 55 while being reversed. During the conveyance, the original MS is passed directly above the first surface fixed reading unit 151 of the scanner 150, immediately after the original MS is reversed. At this time, an image on the first surface of the original MS is read by the first surface fixed reading unit 151 of the scanner 150.

Figure 7:
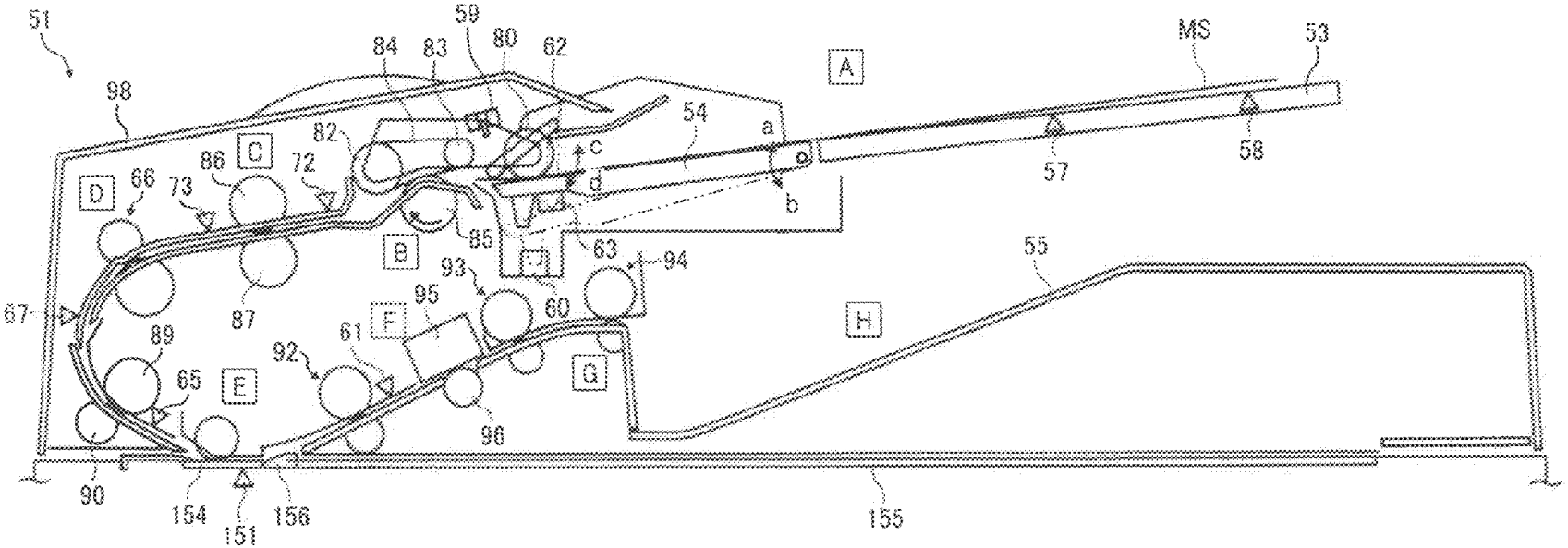
FIG. 7 is an enlarged schematic of a key portion of the ADF and an upper portion of the scanner.

FIG. 7 is an enlarged schematic of a key portion of the ADF 51 and an upper portion of the scanner 150. The ADF 51 includes an original setting unit A, a separating/feeding unit B, a registration unit C, a turning unit D, a first reading/conveying unit E, a second reading/conveying unit F, a paper discharging unit G, a stacking unit H, and the like.

The original setting unit A includes the platen 53 to which a bundle of originals MS is set, and the like. The separating feeding unit B separates and feeds the originals MS one by one, from the bundle of originals MS being set. The registration unit C temporary stops the original MS being fed, and sends out the original MS after aligning the original MS. The turning unit D includes a turning conveying unit that turns the original MS in a shape of C, and the top and bottom of the original MS is reversed, while the original MS is turned in the turning conveying unit. The first reading/conveying unit E makes the first surface fixed reading unit 151 arranged in the scanner, which is not shown, at a lower portion of the first contact glass 154 read the first surface of the original MS, while conveying the original MS on the first contact glass 154. The second reading/conveying unit F makes a second fixed reading unit 95 read the second surface of the original MS, while conveying the original MS under the second fixed reading unit 95. The paper discharging unit G discharges the original MS whose images on both sides are being read, towards the stacking unit H. The stacking unit H stacks the originals MS on the stacking platen 55.

The leading edge of the original MS is placed on a movable original platen 54 movable in the directions of arrows a and b in FIG. 7, depending on the thickness of the bundle of originals MS. The original MS is set in a state in which the rear edge of the original MS is placed on the platen 53. At this time, on the platen 53, the position of the original MS in the width direction is adjusted, because side guides, which are not shown, are pressed against both ends of the original MS in the width direction (direction perpendicular to the diagram). The original MS set in this manner pushes up a lever member 62 movably arranged above the movable original platen 54. Accordingly, an original set sensor 63 detects that the original MS is set, and transmits a detection signal to a controller, which is not shown. The detection signal is sent to a reading controlling unit of the scanner from the controller, through an interface (I/F).

The platen 53 includes a first length sensor 57 and a second length sensor 58 made of a reflection photosensor or an actuator-type sensor that detect the length of the original MS in the conveying direction. The length sensors detect the length of the original MS in the conveying direction.

Above the bundle of originals MS placed on the movable original platen 54, a pickup roller 80 movably supported by a cam mechanism in the vertical direction (in the directions of arrows c and d in FIG. 7) is arranged. Because the cam mechanism is driven by a pickup motor 56, it is possible to move the pickup roller 80 in the vertical direction. When the pickup roller 80 moves upwards, the movable original platen 54 moves in the direction of the arrow a in FIG. 7. Accordingly, the pickup roller 80 comes in contact with the uppermost original MS of the bundle of originals MS. When the movable original platen 54 moves further upwards, a table lifting detection sensor 59 detects the elevation of the movable original platen 54 to the upper limit. Consequently, the pickup motor 56 is stopped and the elevation of the movable original platen 54 is also stopped.

For a main body operating unit formed of a numeric keypad, a display, and the like provided on the main body of the copier, an operator performs key operation for setting a reading mode, between a double-sided reading mode or a single-sided reading mode, or presses a copy start key. When the copy start key is pressed, the main body controlling unit, which is not shown, sends an original supply signal to the controller of the ADF 51. Accordingly, the pickup roller 80 is rotationally driven by the normal rotation of a paper feed motor 76, and the original MS on the movable original platen 54 is sent out from the movable original platen 54.

To set a double-sided reading mode or a single-sided reading mode, the double-sided or the single-sided can be collectively set for all the originals MS placed on the movable original platen 54. It is also possible to individually set the reading mode for an individual original MS, so as the first and the tenth originals MS are set to the double-sided reading mode, and the other originals MS are set to the single-sided reading mode.

The original MS fed out by the pickup roller 80 enters the separating/feeding unit B, and is sent to an abutting position with a paper feed belt 84. The paper feed belt 84 is stretched by a drive roller 82 and a driven roller 83, and the paper feed belt 84 endlessly moves by the rotation of the drive roller 82 in the clockwise direction in FIG. 7, with the normal rotation of the paper feed motor 76. A reverse roller 85 rotationally driven in the clockwise direction in FIG. 7 by the normal rotation of the paper feed motor 76, is brought in contact with the lower stretched surface of the paper feed belt 84. At the abutting portion, the surface of the paper feed belt 84 moves in the paper feed direction. Alternatively, the reverse roller 85 is brought in contact with the paper feed belt 84 at a predetermined pressure. While the reverse roller 85 is directly brought in contact with the paper feed belt 84, or when only one piece of the original MS is nipped at the abutting portion, the reverse roller 85 rotates along the belt or the original MS. However, when a plurality of originals MS are nipped at the abutting portion, the co-rotation force is lower than torque of a torque limiter. Accordingly, the reverse roller 85 rotates and drives in the clockwise direction in FIG. 7, opposite to the co-rotation direction. Consequently, moving force in the direction opposite to the feeding of paper is applied to the originals MS under the uppermost original MS, by the reverse roller 85, and only the uppermost original MS is separated from the originals.

A sheet of the original MS separated by the paper feed belt 84 and the reverse roller 85 enters the registration unit C. The leading edge of the original MS is detected, when the original MS passes directly below an abutment sensor 72. At this time, the pickup roller 80 receiving the drive force of the pickup motor 56 is still rotationally driven. However, the pickup roller 80 is separated from the original MS because the movable original platen 54 is lowered. Accordingly, the original MS is conveyed only by the endless movement of the paper feed belt 84. The endless movement of the paper feed belt 84 is continued for a predetermined period of time, from the timing when the leading edge of the original MS is detected by the abutment sensor 72. The leading edge of the original MS is pressed against an abutting portion of a pull-out drive roller 86 and a pull-out driven roller 87 rotationally driven while in contact with the pull-out drive roller 86.

The pull-out driven roller 87 serves to convey the original MS to a pair of intermediate rollers 66 at the downstream in the original conveying direction. The pull-out driven roller 87 is rotationally driven by the reverse rotation of the paper feed motor 76. When the paper feed motor 76 rotates in reverse, the pull-out driven roller 87 and one roller of the pair of intermediate rollers 66 in contact with each other start rotating, thereby stopping the endless movement of the paper feed belt 84. At this time, the rotation of the pickup roller 80 is also stopped.

The original MS fed out from the pull-out driven roller 87 passes directly below an original width sensor 73. The original width sensor 73 includes a plurality of paper detecting units made of a reflection photosensor and the like. The paper detecting units are aligned in the original width direction (in the direction perpendicular to the diagram). The size of the original MS in the width direction is detected, based on which paper detecting unit detects the original MS. The length of the original MS in the conveying direction is detected, based on from when the leading edge of the original MS is detected by the abutment sensor 72 and to when the rear edge of the original MS is not detected by the abutment sensor 72.

The leading edge of the original MS whose size in the width direction is detected by the original width sensor 73 enters the turning unit D, and nipped at the abutting portion of the rollers of the pair of intermediate rollers 66. The conveying speed of the original MS by the pair of intermediate rollers 66 is set higher than the conveying speed of the original MS by the first reading/conveying unit E, which will be described later. Accordingly, the time required to send the original MS to the first reading/conveying unit E is reduced.

The leading edge of the original MS conveyed through the turning unit D passes through a position opposite to a reading entrance sensor 67. When the leading edge of the original MS is detected by the reading entrance sensor 67, the conveying speed of the original by the pair of intermediate rollers 66 is reduced, while the leading edge is conveyed to a position of a pair of reading entrance rollers (pair of 89 and 90) at the downstream in the conveying direction. With the start of the rotation drive of a reading motor 77, one of the pair of reading entrance rollers (89 and 90), one of a pair of reading exit rollers 92, and one of a pair of second reading exit rollers 93 start the rotation drive.

In the turning unit D, the front and rear surfaces of the original MS are reversed, while the original MS is conveyed through the turning/conveying path between the pair of intermediate rollers 66 and the pair of reading entrance rollers (89 and 90). The conveying direction is also reversed. The leading edge of the original MS passed through a nip between the pair of reading entrance rollers (89 and 90) passes directly below a registration sensor 65. At this time, when the leading edge of the original MS is detected by the registration sensor 65, the conveying speed of the original is slowed down over a predetermined conveying distance. Accordingly, the conveyance of the original MS is temporally stopped immediately before the first reading/conveying unit E. A registration stop signal is transmitted to the reading controlling unit, which is not shown.

When the reading controlling unit that received the registration stop signal transmits a read start signal, the controller of the ADF 51 controls, so as to restart the rotation of the reading motor 77 and to increase the conveying speed of the original MS up to a predetermined conveying speed, until the leading edge of the original MS reaches the first reading/conveying unit E. Accordingly, at a timing when the leading edge of the original MS reaches the reading position of the first surface fixed reading unit 151, calculated based on a pulse count of the reading motor 77, the controller transmits a gate signal that indicates a valid image area of the first surface of the original MS in the sub-scan direction to the reading controlling unit. The transmission is continued until the rear edge of the original MS slips out from the reading position of the first surface fixed reading unit 151. Accordingly, the first surface of the original MS is read by the first surface fixed reading unit 151.

The leading edge of the original MS that has passed through the first reading/conveying unit E is detected by a paper discharge sensor 61, after the original MS went though the pair of reading exit rollers 92, which will be explained later. When the single-sided reading mode is being set, the reading of the second surface of the original MS by the second fixed reading unit 95, which will be explained later, is not required. Accordingly, when the leading edge of the original MS is detected by the paper discharge sensor 61, the normal rotation drive of a paper discharging motor 78 is started, and a paper discharge roller at the lower side of a pair of paper discharge rollers 94 in FIG. 7 is rotationally driven in the clockwise direction in FIG. 7. Based on a pulse count of the paper discharging motor from when the leading edge of the original MS is detected by the paper discharge sensor 61, the timing when the rear edge of the original MS slips though a nip of the pair of paper discharge rollers 94 is calculated. Based on the calculated result, the driving speed of the paper discharging motor 78 is slowed down, at the timing just before the rear edge of the original MS slips out from the nip of the pair of paper discharge rollers 94. Accordingly, the original MS is discharged at the speed so as not to spring out from the stacking platen 55.

When a double-sided reading mode is set, after the leading edge of the original MS is detected by the paper discharge sensor 61, the timing when the original MS reaches the second fixed reading unit 95 is calculated, based on the pulse count of the reading motor 77. At the timing, the controller transmits a gate signal that indicates a valid image area of the second surface of the original MS in the sub-scan direction to the reading controlling unit. The transmission is continued until the rear edge of the original MS slips out from the reading position of the second fixed reading unit 95, and the second surface of the original MS is read by the second fixed reading unit 95.

The second fixed reading unit 95 as a reading unit is formed of a contact-type image sensor (CIS), and a coating treatment is applied to the reading surface, to prevent vertical stripes from being generated. The vertical stripes are generated when a paste-like foreign substance disposed on the original MS is disposed on the reading surface. At a position opposite to the second fixed reading unit 95, a second reading roller 96 as an original supporting unit that supports the original MS from the side of the surface not being read (side of the first surface) is arranged. The second reading roller 96 prevents the original MS from floating, at the reading position of the second fixed reading unit 95, and functions as a reference white portion used for obtaining shading data in the second fixed reading unit 95.

Experiments conducted by the present inventors will now be described.

Figure 8:
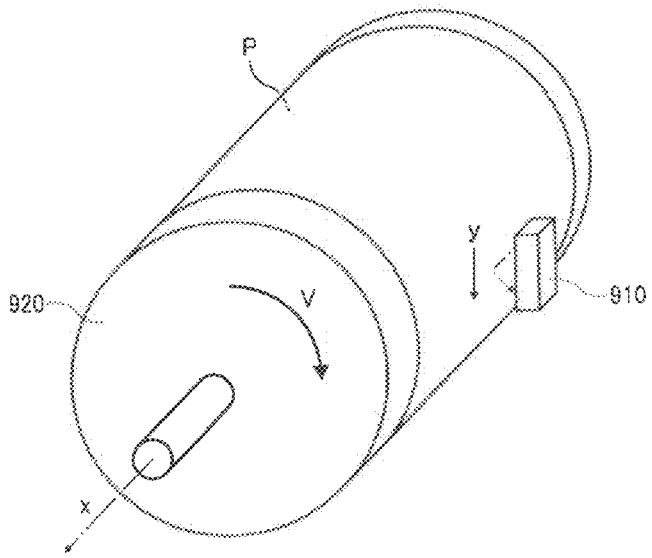
FIG. 8 is a perspective view of an experimental device used by the present inventors.

The present inventors prepared an experimental device as shown in FIG. 8. The experimental device includes a rotation drum 920 rotationally driven by a driving unit, which is not shown, at the linear speed V in the clockwise direction in FIG. 8, and the optical displacement sensor 910 arranged at the side of the rotation drum, so as to oppose to the surface of the drum interposing a predetermined space. The surface of the rotation drum 920 is mirror finished, and diffused reflection light is seldom generated. Accordingly, an LED-type optical displacement sensor, which will be described later, that detects diffused reflection light, cannot detect the surface movement of the rotation drum 920. Consequently, a recording paper P is wrapped around the surface of the rotation drum 920. A rotation drum having a diameter of 100 millimeters is used as the rotation drum 920, and the rotation drum is rotated at the speed of 20 revolutions per minute to 200 revolutions per minute (calculated linear speed of 105 mm/s to 1047 mm/s). In FIG. 8, the direction of an arrow y is the moving direction of the surface of the rotation drum 920, at the position opposite to the optical displacement sensor 910. The direction of an arrow x is the rotational axis direction of the rotation drum 920, and the direction of the arrow x is perpendicular to the direction of the arrow y.

Figure 9:
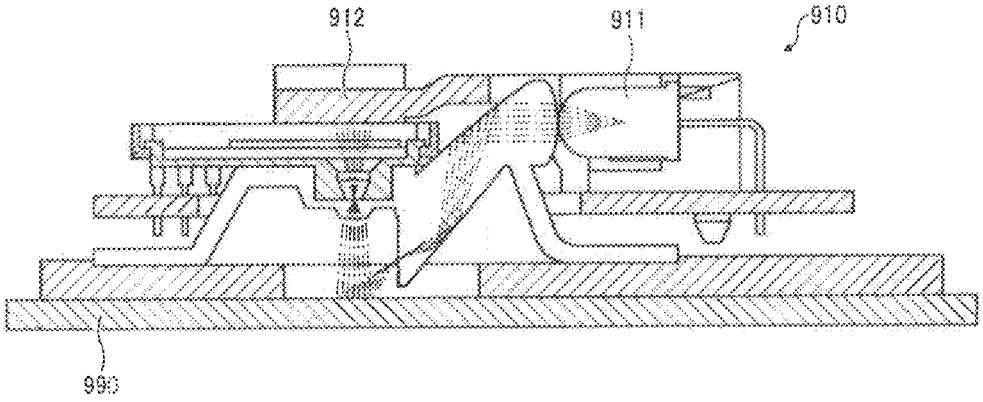
FIG. 9 is an enlarged schematic of an example of a light emitting diode (LED) type optical displacement sensor.
Figure 10:
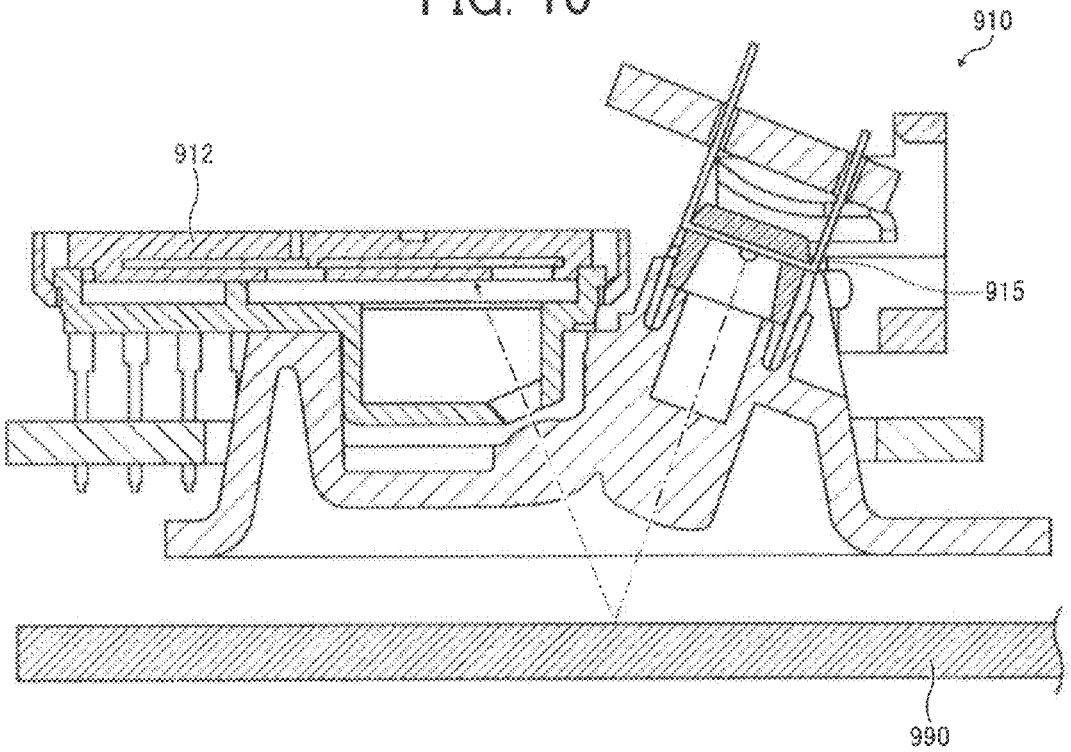
FIG. 10 is an enlarged schematic of an example of a laser diode (LD) type optical displacement sensor.

The optical displacement sensor 910 is broadly classified into an LED type and a laser diode (LD) type. The LED type optical displacement sensor 910, as shown in FIG. 9, for example, reflects light beam (wavelength $\lambda$=639 nanometers) emitted from an LED 911 as a light emitting element, at the surface of an object to be detected 990. The obtained reflection light is received by light receiving elements of an imaging module 912 in which a plurality of light receiving elements, which are not shown, are arranged in a matrix. Accordingly, a light receiving pattern is obtained by each of the light receiving elements. After a predetermined light receiving pattern obtaining period (inverse number of a frame rate) has passed, the difference between the obtained light receiving pattern and the previous light receiving pattern is identified. The moving distance of the object to be detected 990 in the x direction and the moving distance the object to be detected 990 in the y direction are identified and temporally stored therein. Corresponding to a read command sent from a computer processing unit (CPU), which is not shown, at a predetermined sampling period, the moving distance data is output. The LD type optical displacement sensor 910 reflects laser light (wavelength $\lambda$=832 nanometers to 865 nanometers) emitted from a Vertical-Cavity Surface-Emitting Laser (VCSEL) module 915 as a light emitting element at the surface of the object to be detected 990. The LD type is different from the LED type, in using coherent laser light. Accordingly, it is possible to obtain an interference pattern of reflection light even if the surface has fine irregularities. Both the LD type and the LED type are commercially available from "Avago Technologies" Limited. In the experiments, "ADNS-3080", which is an LED type, commercially sold by the Avago Technologies was used. In the optical displacement sensor 910, the matrix of the light receiving elements of the imaging module 912 is 30×30 pixels, and a signal corresponding to the moving distances in the x direction and the y direction is output, by incorporating the light receiving patterns of 2000 frames to 6469 frames per second. An LD type optical displacement sensor having the performance equal to or more than the LED type is also commercially available.

Figure 11:
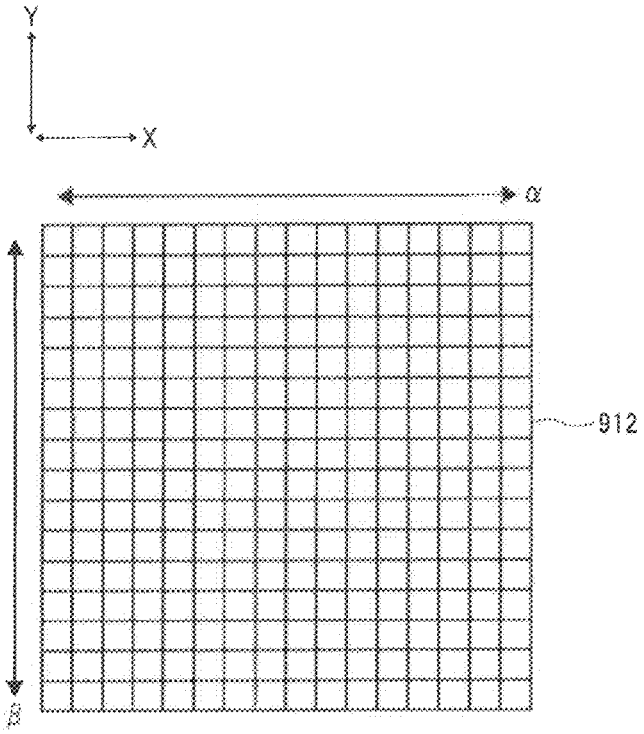
FIG. 11 is a schematic for explaining a general arrangement of an optical displacement sensor.

FIG. 11 is a schematic for explaining a general arrangement of an optical displacement sensor. To detect the displacement of the object to be detected on an X-Y coordinate, the optical displacement sensor is generally arranged, as shown in FIG. 11, in a position that the $\alpha$ direction toward which a plurality of light receiving elements of the imaging module is horizontally arranged is aligned along the X direction, and the $\beta$ direction toward which the plurality of light receiving elements is vertically arranged is aligned along the Y direction. From an output terminal for the $\alpha$ direction of the optical displacement sensor arranged in this manner, for example, if the object to be detected moves by three pixels in the X direction during a predetermined sampling period, a signal indicating "three" is output. From an output terminal for the $\beta$ direction of the optical displacement sensor, for example, if the object to be detected moves by four pixels in the Y direction during the predetermined sampling period, a signal indicating "four" is output. In this manner, in the optical displacement sensor, a pixel value corresponding to the displacement of the object to be detected is output as an integer (discrete value). In other words, the optical displacement sensor detects the displacement of the object to be detected in a pixel unit.

Figure 12:
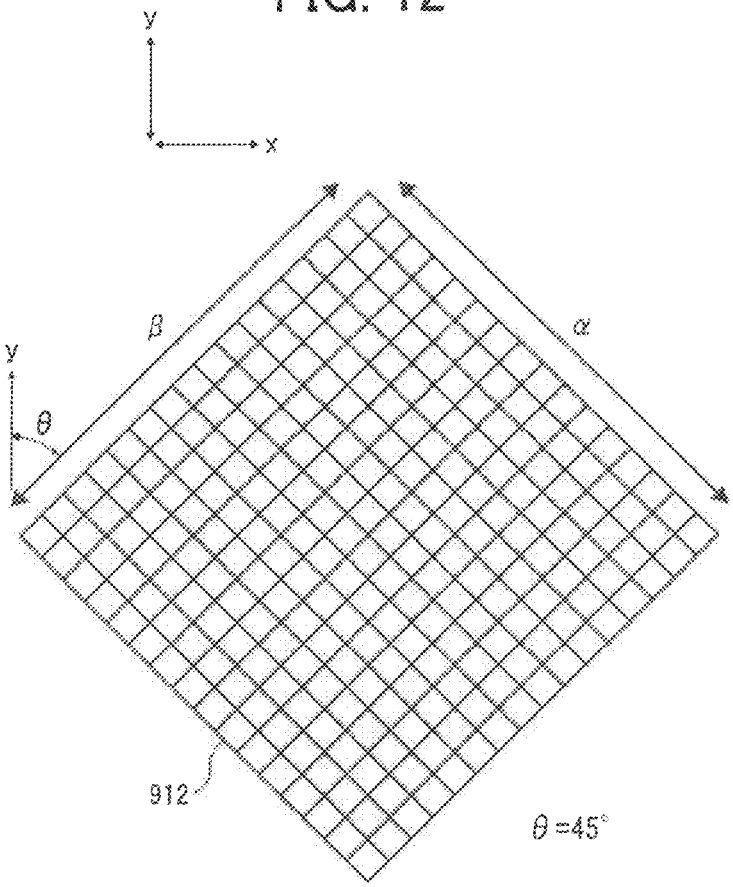
FIG. 12 is a schematic for explaining the arrangement of an optical displacement sensor according to the experimental device.

FIG. 12 is a schematic for explaining the arrangement of an optical displacement sensor according to the experimental device. In the experimental device, as shown in FIG. 12, the optical displacement sensor 910 is arranged in a position that the $\alpha$ direction and the $\beta$ direction of the imaging module are tilted to the y direction, which is the surface moving direction of the rotation drum as an object to be detected. In the imaging module 912 of the optical displacement sensor used for the experiment, the matrix of light receiving elements are 30×30 pixels. However, in FIG. 12, the matrix of light receiving elements is indicated by 16×16 pixels for descriptive purpose.

In the state in which the optical displacement sensor 910 is arranged in the position shown in FIG. 12, if the rotation drum 920 is rotated and the surface is moved in the y direction, approximately the same values are output from the output terminal for the α direction and the output terminal for the β direction of the optical displacement sensor 910. This is because, in the aforementioned FIG. 12, if the moving distance of the object to be detected in the α direction is indicated by α, and the moving distance of the object to be detected in the β direction is indicated by β, for example, the optical displacement sensor detects the movement of the object to be detected of one pixel in the α direction and the movement of one pixel in the β direction, every time the object to be detected moves as much as the square root of "$\alpha_2+\beta_2$" in the y direction. In the experimental device, the surface of the rotation drum 920 as an object to be detected does not moves in the x direction. Accordingly, the moving distance of the drum surface in the y direction is expressed by $$\sqrt{\alpha^2+\beta^2} \tag{1}$$

Figure 13:
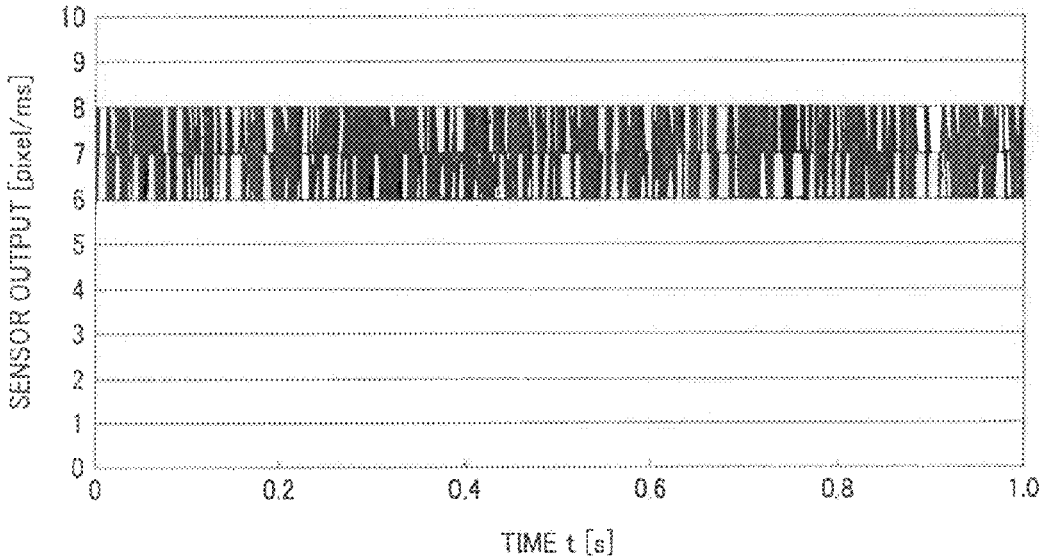
FIG. 13 is a graph of output waveforms from the optical displacement sensor of the experimental device displaced in the $\alpha$ direction.

FIG. 13 is a graph showing output waveforms from the optical displacement sensor 910 of the experimental device displaced in the α direction. The output waveforms are obtained, by arranging the optical displacement sensor 910 in a position in which the α direction is aligned along the y direction, which is the surface moving direction of the rotation drum 920, and rotating the rotation drum 920 at the linear speed of 419 mm/s. The sampling period of the output is 1 millisecond. If the sampling is carried out at 1 millisecond period, while moving the object to be detected at the speed of 419 mm/s in the y direction (see FIG. 12), the output of the optical displacement sensor 910 displace in the α direction is an integer value of "6", "7", or "8". To use the sensor as optical mice, such an output may be convenient. However, to continuously observe the displacement of the object to be detected, it is preferable to identify displacement smaller than a pixel. Accordingly, the present inventors considered to utilize the average of values output from the optical displacement sensor during a predetermined period of time as the continuous displacement. Even when the y direction, which is the surface moving direction of the rotation drum 920, and the β direction of the optical displacement sensor 910 are matched with each other, the output waveforms from the sensor displaced in the β direction are the same.

Figure 14:
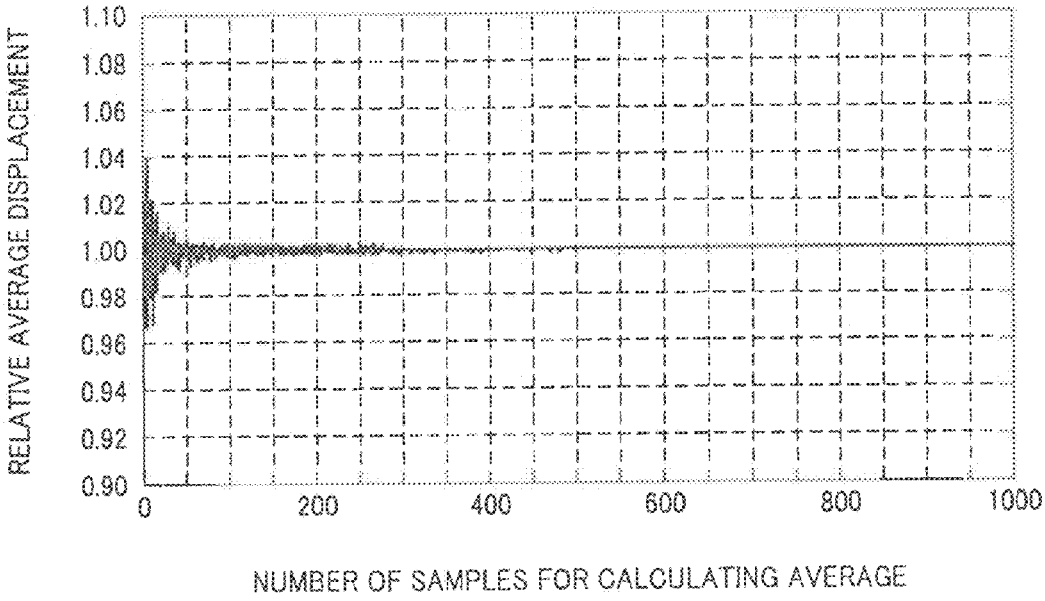
FIG. 14 is a graph of the relationship between a relative value of the average displacement to the reference displacement, and the number of samples for calculating the average.

To average the sensor outputs, an average displacement of 1000 samples is calculated, to find out how much sample data is required to obtain an average. By using the average displacement as a reference displacement, a relative value of the average displacement obtained from various numbers of samples for calculating an average for the reference displacement is calculated. FIG. 14 is the relationship between the relative value and the number of samples for calculating the average. If the number of samples for calculating the average is 1000, the average displacement is the reference displacement itself. In FIG. 14, the relative value is one, when the number of samples for calculating the average is 1000. As the number of samples for calculating the average is reduced, the amplitude of the graph is increased. Under a condition in which the size of amplitude of the relative value is equal to or less than ±1%, the present inventors have found out that the stable result can be obtained by taking an average of 20 samples (periods of 20 samples). Accordingly, the average displacement is obtained by averaging the outputs from the optical displacement sensor at every 20 samples.

Figure 15:
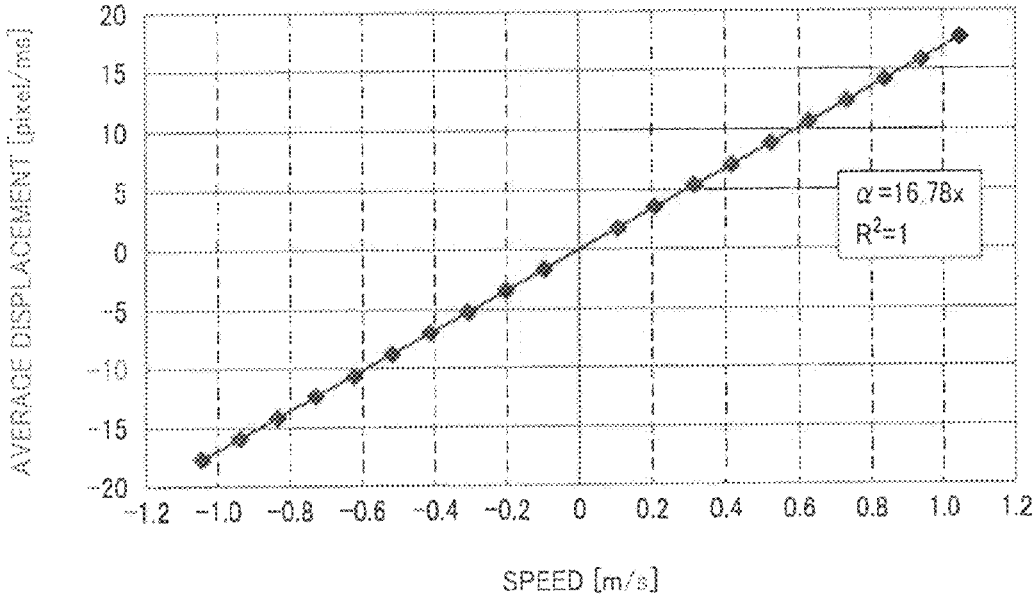
FIG. 15 is a graph of the relationship between the average displacement in which outputs from the optical displacement sensor are averaged at every 20 samples, and the linear speed of a rotation drum of the experimental device.

FIG. 15 is a graph of the relationship between the average displacement in which the outputs of the optical displacement sensor are averaged at every 20 samples, and the linear speed of the rotation drum 920. It is understood that, in the speed range from −1 m/s to 1 m/s, the speed and the average displacement are in good correlation with each other. In FIG. 15, the relationship between the average displacement of the sensor output indicating the displacement in the α direction and the speed is shown. However, the similar relationship can also be established in the β direction.

Figure 16:
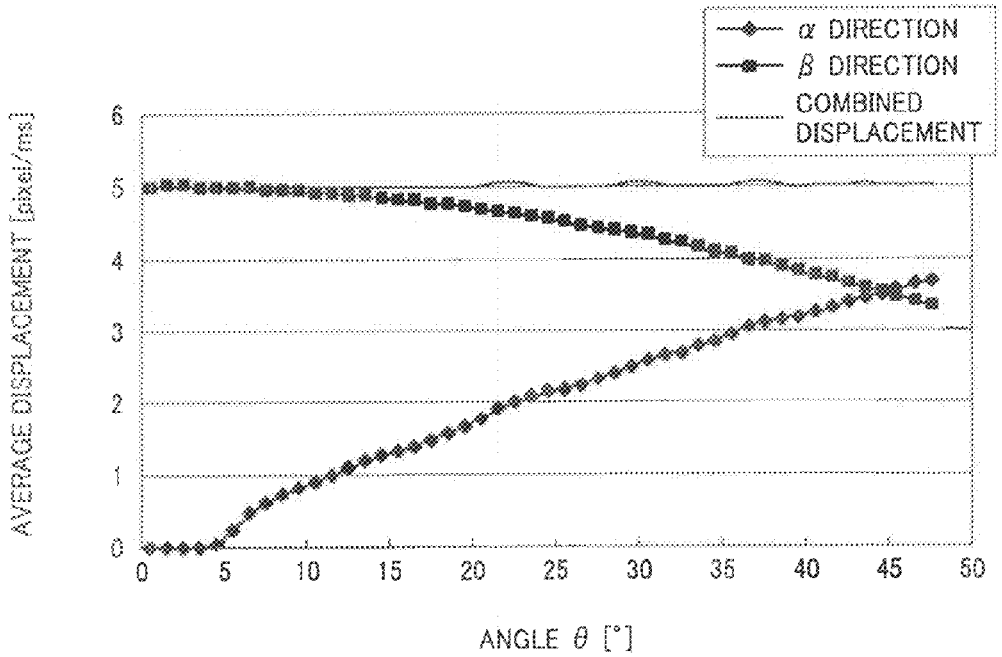
FIG. 16 is a graph of the relationships of an angle $\theta$, an average displacement in the $\alpha$ direction, an average displacement in the $\beta$ direction, and combined displacement.

The present inventors carried out an experiment to investigate the relationship of the average displacement in the α direction, the average displacement in the β direction, and combined displacement obtained by Equation (1), when the angle θ shown in FIG. 12 is gradually increased from 0°. FIG. 16 illustrates the result of the experiment. In the experimental device, the surface of the rotation drum 920, which is the object to be detected, only moves in the y direction. Accordingly, the combined displacement matches with the moving distance of the drum in the y direction. As shown in FIG. 16, in a range in which the angle θ that indicates the tilt of the optical displacement sensor 910 at the state in FIG. 11 is from 0° to 6°, the average displacement in the α direction is substantially zero. However, the average displacement in the β direction is approximately saturated. In the range in which the angle θ is from 0° to 6°, the β direction matches with the y direction, which is the surface moving direction of the drum, or approximately aligns along the y direction. Accordingly, only the movement in the y direction is detected. In other words, in the range in which the angle θ is from 0° to 6°, the oblique movement of the object to be detected cannot be detected. Alternatively, when the angle θ is about 45°, the average displacement in the α direction is significantly large, compared to the condition in which the angle θ=0°. Accordingly, the displacement in the y direction and the displacement in the x direction are both sensitively detected.

A value obtained in Equation (1) is used as a sensitivity index value for the displacement in the α direction, to indicate the presence of sensitivity for the displacement of the angle θ in the α direction, one-dimensionally.

$$\frac{\alpha/\beta}{\sin\theta/\cos\theta} \tag{1}$$

Figure 17:
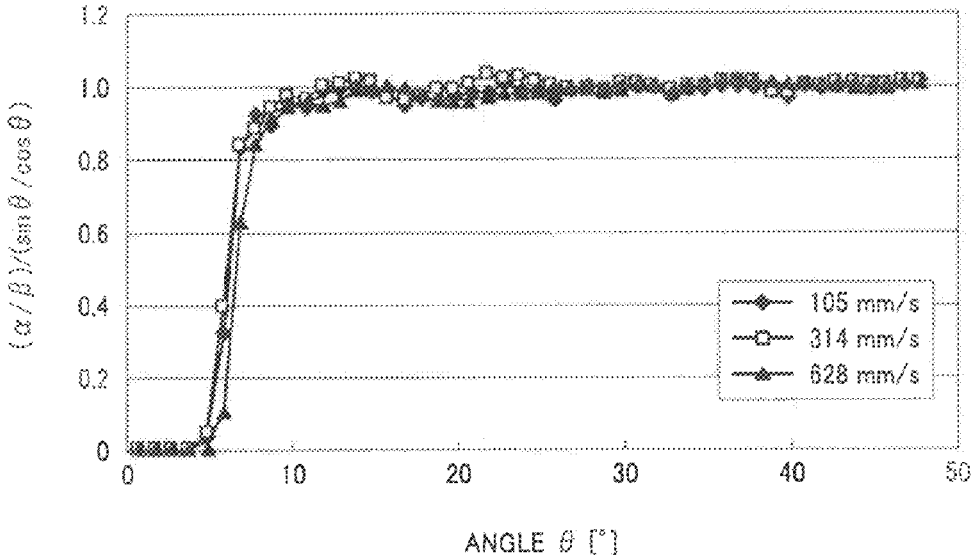
FIG. 17 is a graph of the relationships of a sensitivity index value for the displacement in the x direction, an angle $\theta$, and the linear speed, when the rotation drum is rotated in three linear speed modes different from one another.

FIG. 17 is a graph of the relationships of a sensitivity index value for the displacement in the α direction, the angle θ, and the linear speed, when the rotation drum is rotated in three linear speed modes different from one another. As shown in FIG. 17, in a range in which the angle θ is from 0° to 4°, there is no sensitivity for the displacement in the α direction. However, when the angle θ begins to exceed 5°, the sensitivity for the displacement in the α direction starts to show. When the angle θ is about 10°, the sensitivity for the displacement in the α direction is increased up to near saturation. However, when the angle θ is about 10° to 25°, the saturation sensitivity is stable. Accordingly, when the angle θ is set larger than [°], the saturation sensitivity for the displacement in the α direction can be obtained in a stable manner. Although the reason will be described later, this is because the sensor sensitivities in the α direction and in the β direction are not equal.

The present inventors then carried out an experiment to obtain a sensor output, by rotating the optical displacement sensor 910 at a fine angle in the direction of the angle θ, with reference to the state in which the rotation drum 920 is rotated, while the optical displacement sensor 910 is in a position tilted by the angle θ of 45°. The same state as when the object to be detected is skewed is pseudo-created, by rotating the optical displacement sensor 910 slightly in the direction of the angle θ (at this time, the angle θ is changed from 45°). The skew is a phenomenon in which the object to be detected does not proceed straight in the y direction, which is a conveying direction, but proceeds in a state tilted from the y direction. To investigate whether a fine skew angle can be detected, a gradient index value A used as an index for a skew angle by the pseudo skew is calculated, by substituting the average displacement (α) in the α direction and the average displacement (β) in the β direction, calculated based on the output from the optical displacement sensor 910, by Equation (3).

$$A = \frac{\alpha - \beta}{\sqrt{\alpha^2 + \beta^2}} \times 100[\%] \tag{3}$$

The gradient index value A takes the difference between the average displacement α in the α direction and the average displacement β in the β direction, to enhance the detection accuracy, by obtaining the skew angle ϕ while including the displacements in both directions. The reason why the difference is divided by a synthetic displacement (square root of $\alpha^2+\beta^2$) is to standardize to eliminate the influence of speed. With the standardization, it is possible to separate and detect the skew angle ϕ from the speed.

Figure 18:
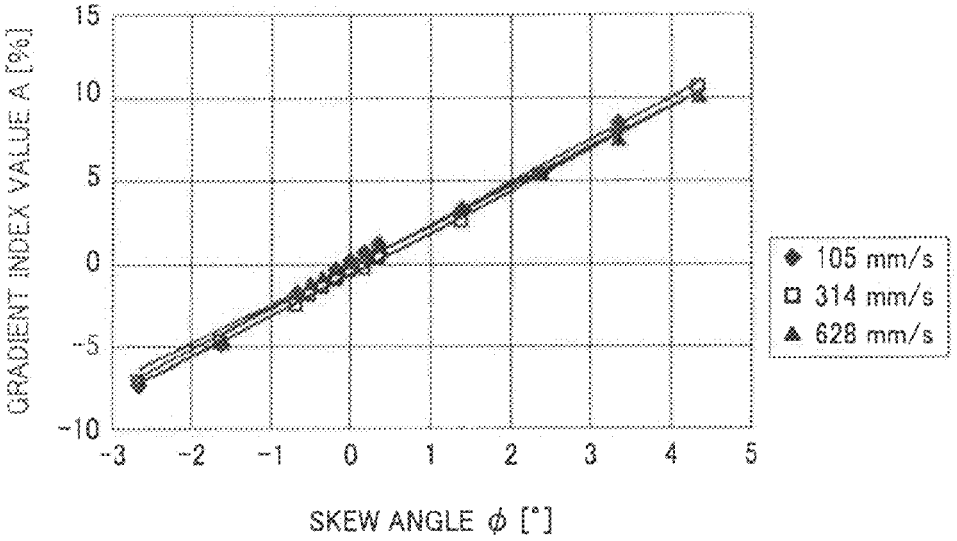
FIG. 18 is a graph of the relationship between a gradient index value A and a skew angle $\phi$.

FIG. 18 is the relationship between the gradient index value A and the skew angle ϕ obtained from the moving distance of the optical displacement sensor 910 in the x direction. At around 0°, the skew angle ϕ is changed at short intervals of every ⅙°, and the small change can be sensitively detected. Accordingly, it is confirmed that the skew angle ϕ of the object to be detected can be detected by the resolution equal to or less than ⅙°, by tilting the optical displacement sensor 910 at the angle θ of 45°.

Figure 19:
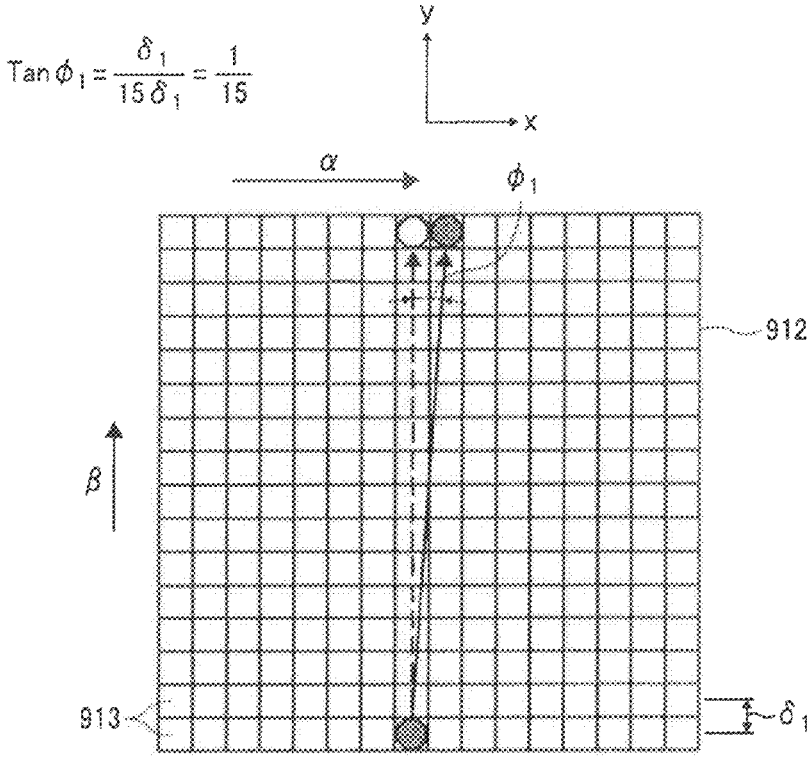
FIG. 19 is a schematic of the relationship between an imaging module under the condition that the angle $\theta=0°$ and a skew angle $\phi_1$ of an object to be detected.

FIG. 19 is a schematic of the relationship between the imaging module 912 of the optical displacement sensor so arranged that the angle θ is set to 0°, and a skew angle $\phi_1$ of the object to be detected. In the experiment, as described above, the imaging module of 30×30 pixels is used. However, in FIG. 19, the matrix of the imaging module 912 is shown by 16×16 pixels for descriptive purpose (similar in FIG. 20, which will be described later). At a certain sampling timing, a characteristic location (circle) of the object to be detected is obtained, by a light receiving element 913 placed at the lower end in the β direction. Assume that the characteristic location is obtained by the light receiving element 913 placed at the upper end in the β direction, at the next sampling time. At this time, the gradient of the object to be detected in the moving direction in the y direction, which is the conveying direction (tangent of $\phi_1$) is 1/15, as shown in FIG. 19. The gradient smaller than 1/15 cannot be detected by the example shown in FIG. 19.

Figure 20:
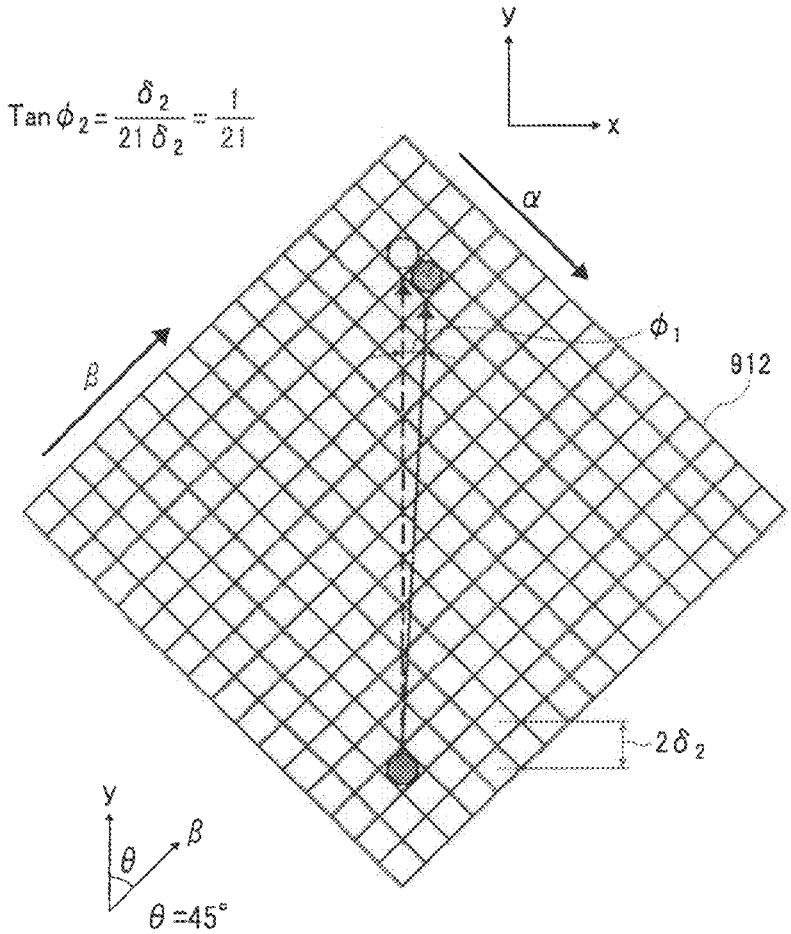
FIG. 20 is a schematic of the relationship between an imaging module under the condition that the angle $\theta=0°$ and a skew angle $\phi_2$ of the object to be detected.

FIG. 20 is a schematic of the relationship between the imaging module 912 of the optical displacement sensor so arranged that the angle θ is set to 45°, and a skew angle $\phi_2$ of the object to be detected. When the angle θ of the optical displacement sensor is tilted by 45°, as shown in FIG. 20, the gradient of the object to be detected in the moving direction in the y direction can be detected by the resolution of 1/21. In other words, under the condition in which the angle θ is set to 45°, compared to when the angle θ is set to 0°, it is possible to detect a smaller skew angle ($\phi_1 > \phi_2$).

If the smaller skew angle can be detected, the stable average displacement can be obtained, by a less number of samples. For example, as described above, under the condition in which the angle θ is set to 45°, it is already described that the stable average displacement can be obtained, by taking an average of 20 samples, at the sampling period of 1 m/s. However, under the condition in which the angle θ is set to 0°, the stable average displacement cannot be obtained, unless the number of samples is increased.

In general, in the optical displacement sensor, the frame rate is changed corresponding to the speed of the object to be detected, so that the change of speed of approximately 0 m/s to 1 m/s can be continuously detected, within the detection area of a mere 30×30 pixels. When the speed of the object to be detected is relatively fast, the frame rate is increased (light receiving pattern obtaining period is shortened). When the speed of the object to be detected is relatively slow, the frame rate is decreased. When the object to be detected is skewed, the object to be detected also moves in the direction perpendicular to the conveying direction (x direction), in addition to the conveying direction (y direction). However, at per unit time, the displacement of the object to be detected in the x direction is very small compared to the displacement in the y direction. The moving speed in the x direction is also low compared to the moving speed in the y direction. For example, if the skew angle ϕ is 1°, the moving speed in the x direction is approximately 17% of the moving speed in the y direction. If the frame rate is relatively increased, corresponding to the fact that the moving speed in the y direction is relatively fast, the displacement in the y direction can be accurately detected in each of the frames. However, in the x direction, the light receiving pattern obtaining period is too short compared to the speed in the x direction. Accordingly, it is difficult to obtain the displacement in each frame in the x direction. However, when the angle θ is set to 45° so as to obtain a smaller skew angle ϕ, compared to when the angle θ is set to 0', the displacement in each frame in the x direction can be easily obtained. Consequently, it is possible to calculate the stable average displacement with relatively small number of samples.

Figure 21:
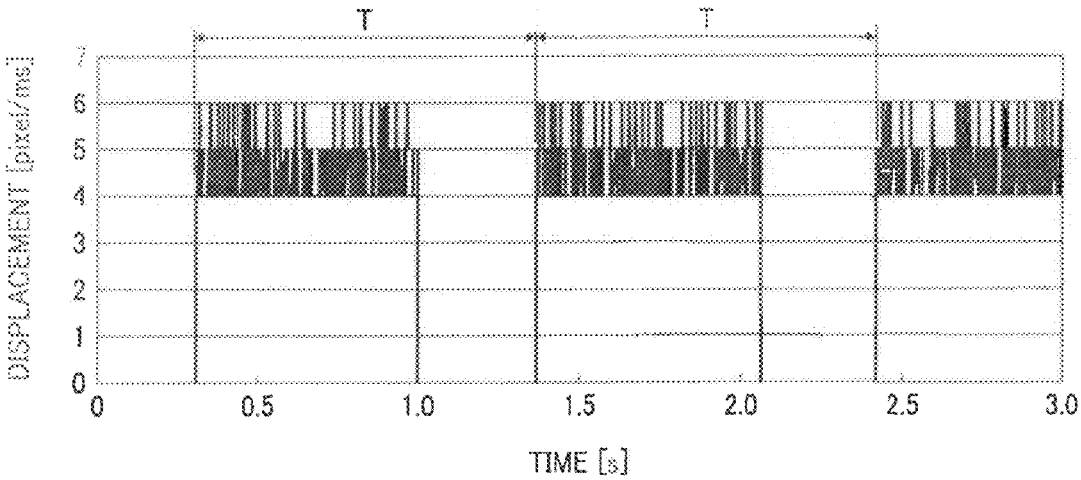
FIG. 21 is a graph of outputs of the optical displacement sensor under the condition in which a recording paper P is partially wrapped around a peripheral surface of the rotation drum.

The present inventors then carried out an experiment to investigate outputs from the optical displacement sensor, by providing areas where the recording paper P is not wrapped at a predetermined pitch in the peripheral direction, instead of wrapping the recording paper P over the entire periphery of the rotation drum 920, by using the experimental device shown in FIG. 8. FIG. 21 illustrates the obtained result. As shown in FIG. 21, the outputs from the optical displacement sensor are intermittently received. This is because, on the pure surface of the drum to which the recording paper P is not wrapped, diffused reflection light is not obtained, and is not detected by the imaging module. Even when the optical displacement sensor is arranged so as to set the recording paper P in the conveying path that conveys the recording paper P as the object to be detected, the output from the optical displacement sensor is eliminated, similar to when the recording paper P is not present in the conveying path. In other words, the presence of the recording paper P can be identified, based on the presence of outputs from the optical displacement sensor.

Figure 22:
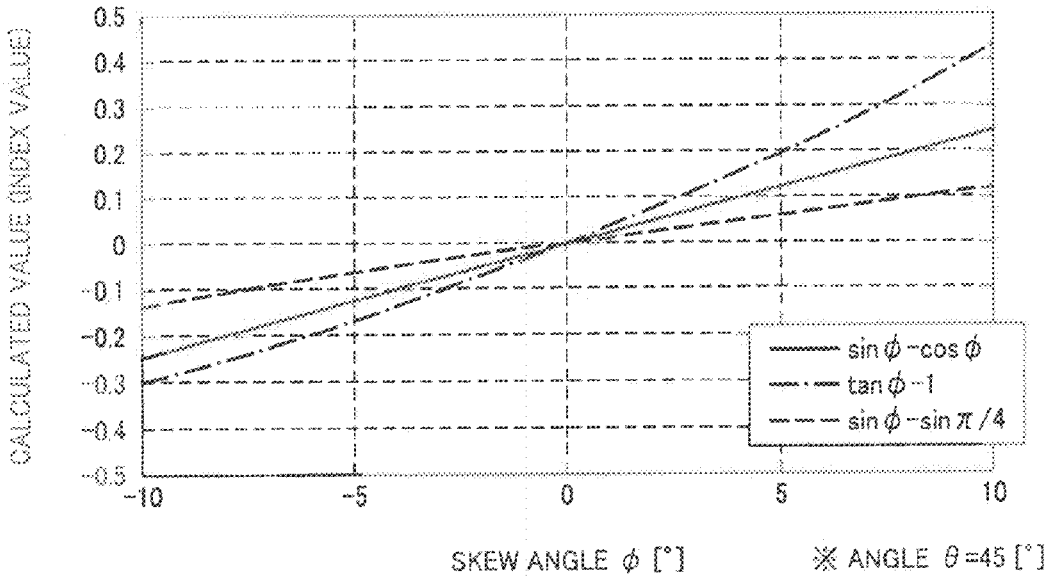
FIG. 22 is a graph of the relationships of various types of gradient index values and skew angles $\phi$.

The present inventors then studied a gradient index value, which is an index of the skew angle ϕ, calculated by using the output from the optical displacement sensor in the α direction and the output from the optical displacement sensor in the β direction. The gradient index value A calculated based on Equation (3) is one of them, but some other gradient index values that indicate good correlation with the skew angle $\phi$ were also considered. All the values are calculated by the displacement in the $\alpha$ direction, the displacement in the $\beta$ direction, and the combined displacement, based on a trigonometric function. As one of them, "sin $\phi$" is studied. The "sin $\phi$" can be obtained by "displacement in x direction/combined displacement". As the other gradient index value, "sin $\phi$−cos $\phi$" is also studied. Sin $\phi$ is obtained by "displacement in x direction/combined displacement", and cos $\phi$ is obtained by "displacement in y direction/combined displacement". Accordingly, the answer is calculated based on the difference between the displacements in both directions. As the other gradient index value, "tan $\phi$" is also studied. As widely known, the relationship of "tan $\phi$=sin $\phi$/cos $\phi$" is established. When sin $\phi$ and cos $\phi$ in the right-hand side of the equation is expressed by various displacements, the right side can be modified to "displacement in x direction/displacement in y direction". In other words, the gradient index value is calculated based on the ratio of the displacement in the x direction and the displacement in the y direction. FIG. 22 is the result of the relationships of three gradient index values and skew angles $\phi$, calculated theoretically. In FIG. 22, one is subtracted from "tan $\phi$" and, "sin $\pi/4$" is subtracted from "sin $\phi$". This is because the positions of three lines are arranged, so as to pass though the origin. When arranged in descending order of large gradient, the order of three lines is "tan $\phi$", "sin $\phi$−cos $\phi$", and "sin $\phi$". In other words, to detect the skew angle $\phi$ with good sensitivity, "tan $\phi$" is advantageous. When arranged in descending order of good linearity, the order of three lines is "sin $\phi$−cos $\phi$", "sin $\phi$", and "tan $\phi$". In other words, to identify the skew angle $\theta$ as it is, "sin $\phi$−cos $\phi$" is advantageous in view of high accuracy.

A characteristic configuration of the copier according to the embodiment will now be described.

In the present copier, the ADF 51 used as a sheet conveying device aforementioned in FIG. 7 adopts a registration sensor formed by an optical displacement sensor as the registration sensor 65. The registration sensor 65 is so arranged that the angle $\theta$ is set to 45°, in the conveying direction (y direction) of the original MS. The controller of the ADF 51, as described by FIG. 21, identifies the presence of the original MS at the position opposite to the sensor, based on a sudden change of the output from the registration sensor 65 formed by an optical displacement sensor. The reading result of an image is corrected, by calculating a gradient index value of the original MS, based on the output in the $\alpha$ direction and the output in the $\beta$ direction, from the registration sensor 65 formed by an optical displacement sensor, and based on the result. As a gradient index value, at least one of the aforementioned gradient index value A, "tan $\phi$", "sin $\phi$−cos $\phi$", and "sin $\phi$" is calculated. Instead of the gradient index value, the displacement in the x direction may be calculated as a movement index value.

Figure 23:
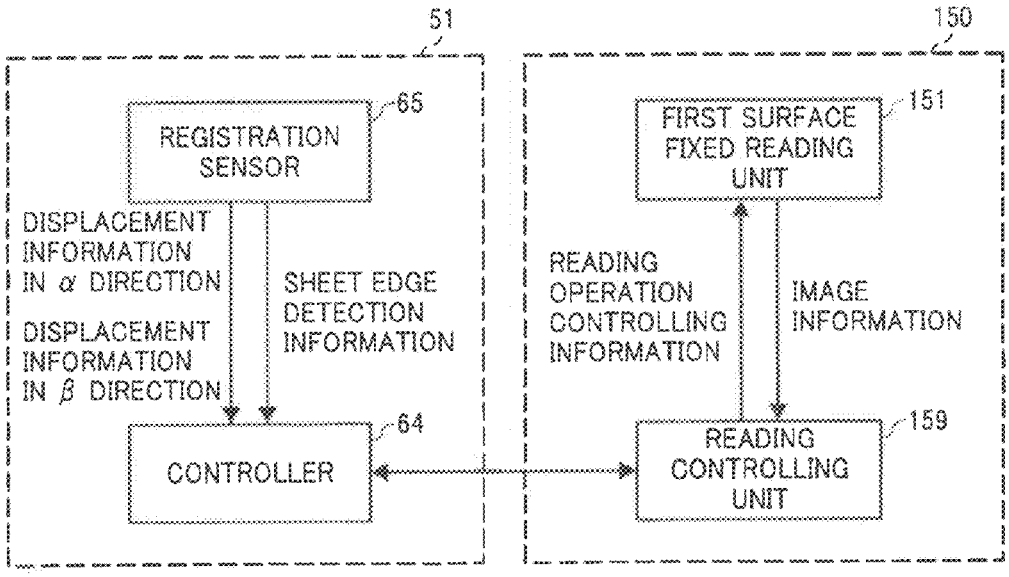
FIG. 23 is a schematic of a part of electric circuits of the scanner and the ADF.

FIG. 23 is a schematic of a part of electric circuits of the scanner 150 and the ADF 51. The output from the registration sensor 65 of the ADF 51 enters a controller 64 of the ADF 51. Based on the output from the registration sensor 65, the controller 64 identifies the timing to detect the leading edge of the original MS, calculates the gradient index value of the original MS being conveyed, and calculates the conveying speed of the original MS in the conveying direction (y direction). The controller 64 then sends the calculation result of the gradient index value, the calculation result of the conveying speed, and the synchronization timing information, to a reading controlling unit 159 of the scanner 150. In the scanner 150, as described above, the image information of the original MS is read by the first surface fixed reading unit 151. At this time, when the original MS is conveyed at a position opposite to the first surface fixed reading unit 151, while being skewed, a tilted image of the original MS will be read. The reading controlling unit 159 obtains correction value data that straights and corrects the inclination of the image due to skew, based on the calculation result of the gradient index value, the calculation result of the conveying speed, and the synchronization timing information sent from the controller 64. Based on the results, the reading controlling unit 159 corrects the image information read and obtained by the first surface fixed reading unit 151. The reading controlling unit 159 then temporarily stores the corrected image information in a data storage unit, and sends the information to the image forming unit.

In the aforementioned FIG. 4, the optical displacement sensor 38 is so arranged that the angle $\theta$ is set to 45°, to the conveying direction (y direction) of the recording paper P. In the image forming unit, the main body controlling unit that receives the output from the optical displacement sensor 38, as described by FIG. 21, identifies the timing when the leading edge of the recording paper P is entered at the position opposite to the sensor, based on the sudden change of the output from the optical displacement sensor 38. The gradient index value of the recording paper P being delivered from the pair of registration rollers 33 is calculated, based on the output from the optical displacement sensor 38. The end of life of the pair of registration rollers 33 is predicted, based on the calculated result. When the pair of registration rollers 33 begins to deteriorate, the skew caused by fluctuation of frictional resistance and deformation of the surface of the rollers is likely to occur. Accordingly, the skew occurs frequently and the skew angle $\phi$ is increased. Consequently, based on the changes of the gradient index values over the time, it is possible to predict the end of life of the pair of registration rollers 33. It is also possible to synchronize with the image formation, by temporarily stopping the rotation drive of the pair of registration rollers 33, at the timing when the optical displacement sensor 38 detects the entrance of the leading edge of the recording paper P, and restarting the rotation drive at the right timing.

At least one of the gradient index value A, "tan $\phi$", "sin $\phi$−cos $\phi$", and "sin $\phi$" is calculated as a gradient index value of the recording paper P. Instead of the gradient index value, the displacement in the x direction may be calculated as a movement index value.

In the transfer unit 24 used as a belt drive device, a belt speed detection sensor 39 is arranged opposite to the rear surface of the belt interposing a predetermined space therebetween, inside the loop of the intermediate transfer belt 25. The belt speed detection sensor 39 is formed of an optical displacement sensor, and so arranged that the angle $\theta$ is set to 45°, to the moving direction (y direction) of the intermediate transfer belt 25. A belt drive controlling unit, which is not shown, that controls the drive of the intermediate transfer belt 25 adjusts the drive speed of a belt drive motor, which is not shown. Accordingly, the belt drive controlling unit adjusts the rotation drive speed of a drive roller, which is one of a plurality of stretching rollers that stretches the intermediate transfer belt 25, thereby adjusting the belt speed. Even if the drive roller is rotated at a constant speed, the intermediate transfer belt 25 does not run at a stable speed. This is due to the eccentricity of the stretching rollers, the fluctuation of the thickness of the intermediate transfer belt 25 in the peripheral direction, and the like. If the speed of the intermediate transfer belt 25 is not stable, an image is disturbed. Accordingly, based on the output from the belt speed detection sensor 39, the belt drive controlling unit identifies the belt running speed of the intermediate transfer belt 25, that is the speed in the roller rotation direction (y direction). The intermediate transfer belt can be driven and run at the stable belt running speed, by feeding back the result of the detected variation of the belt running speed to the drive speed of the belt drive motor.

As a method of identifying the running speed of the intermediate transfer belt 25, a method of detecting the rotation speed of a driven roller rotationally driven by the running belt, while stretching the intermediate transfer belt 25, and identifying the running speed of the belt based on the result has been known. However, with the method, an error occurs to the relationship between the rotation speed of the driven roller and the belt running speed, due to the eccentricity of the driven roller and the fluctuation of the thickness of the intermediate transfer belt 25 in the peripheral direction. Accordingly, it has been difficult to accurately identify the belt running speed.

As a method of identifying the running speed of the intermediate transfer belt 25, a method of detecting a scale having a plurality of scale marks at a predetermined pitch at the end of the belt in the width direction by a reflection photosensor, and identifying the belt running speed based on the detected time interval of the scale marks is known. However, the method has a problem of increasing the cost, because the scale needs to be marked on the intermediate transfer belt 25.

As in the present copier, in which the belt speed detection sensor 39 formed of an optical displacement sensor detects the running speed of the intermediate transfer belt 25, the belt running speed is directly detected by the sensor. Accordingly, deterioration of detection accuracy due to the eccentricity of the driven roller and the fluctuation of the thickness of the intermediate transfer belt 25 in the peripheral direction does not occur. Because the scale need not be marked on the intermediate transfer belt 25, it is possible to prevent the cost from increasing due to providing a scale.

The belt drive controlling unit calculates the gradient index value of the belt, based on the output from the belt speed detection sensor 39 formed of an optical displacement sensor, as well as identifying the speed of the intermediate transfer belt 25 in the running direction (y direction). The belt drive controlling unit then transmits the calculation result to the main body controlling unit. When the stretching rollers that stretch the intermediate transfer belt 25 begin to deteriorate, the intermediate transfer belt 25 tends to run biased to one side, towards the right or the left, in the belt width direction, due to the fluctuation of frictional resistance and deformation. The main body controlling unit predicts the end of life of the stretching rollers, based on the changes of the gradient index values sent from the belt drive controlling unit over the time.

At least one of the gradient index value A, "tan $\phi$", "sin $\phi$−cos $\phi$", and "sin $\phi$" is calculated as a gradient index of the recording paper P. Instead of the gradient index value, the displacement in the x direction may be calculated as a movement index value. The inclination angles of the stretching rollers may be changed, based on the gradient index value or the displacement in the x direction, and let the belt drive controlling unit control and correct the biased running of the belt towards the right or the left.

Figure 24:
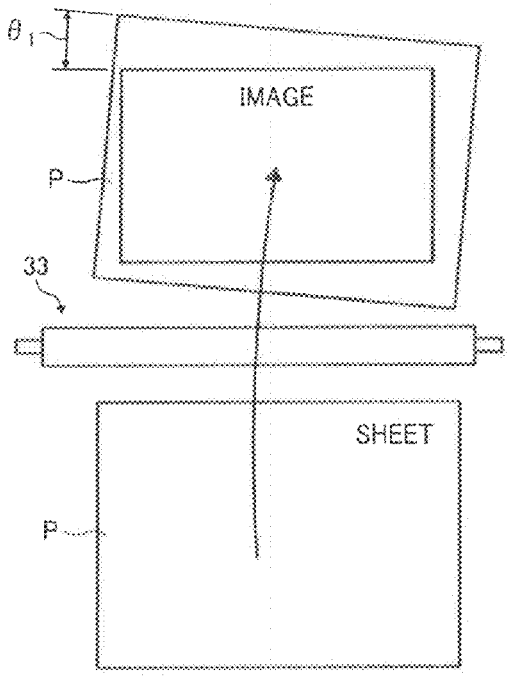
FIG. 24 is a schematic of the relationship between rotational skew of a recording paper generated due to the deterioration of a pair of registration rollers, and image skew.

FIG. 24 is a schematic of the relationship between rotational skew of the recording paper P generated due to the deterioration of the pair of registration rollers 33, and image skew. When the pair of registration rollers 33 is deteriorated due to partial abrasion, deformation, adhesion of foreign matters, and the like, as shown in FIG. 24, so-called rotational skew may occur. The rotational skew moves the recording paper P in an arc, towards the downstream position from the upstream position of the pair of registration rollers 33 in the conveying direction. When the recording paper P enters the secondary transfer nip while being rotated and skewed in this manner, image skew in which the vertical and horizontal directions of the image are inclined to the vertical and horizontal directions of the recording paper P, as shown in FIG. 24, occurs. When the rotational skew occurs, as shown in FIG. 24, the position of the recording paper P is inclined from the conveying direction.

Figure 25:
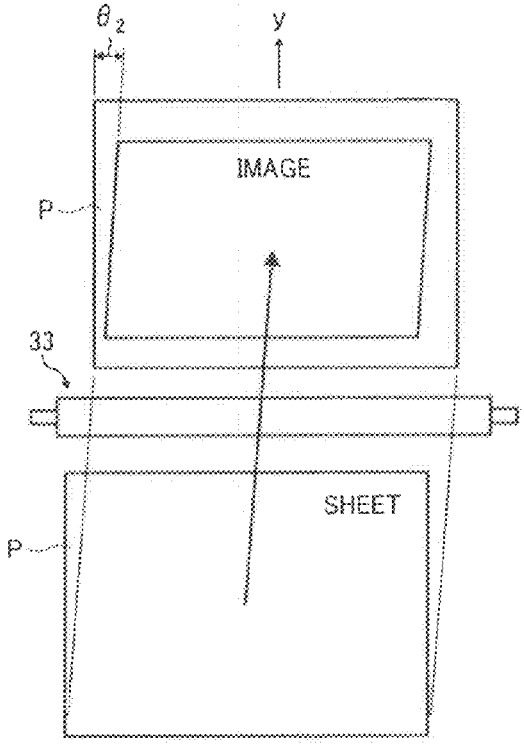
FIG. 25 is a schematic of the relationship between diagonal moving skew of the recording paper generated due to the deterioration of the pair of registration rollers, and image skew.

FIG. 25 is a schematic of the relationship between diagonal moving skew of the recording paper P generated due to the deterioration of the pair of registration rollers 33, and image skew. When the pair of registration rollers 33 is deteriorated, as shown in FIG. 25, so-called diagonal moving skew may occur. The diagonal moving skew moves the recording paper P in the direction inclined from the y direction, which is the conveying direction, towards the downstream position from the upstream position of the pair of registration rollers 33 in the conveying direction. At this time, the position of the recording paper P is upright along the y direction and does not change, but the moving track of the recording paper P is inclined from the y direction. When the recording paper P enters the secondary transfer nip with the moving track inclined in this manner, image skew in which the vertical and horizontal directions of the image are inclined to the vertical and horizontal directions of the recording paper P, as shown in FIG. 25, occurs.

Figure 26:
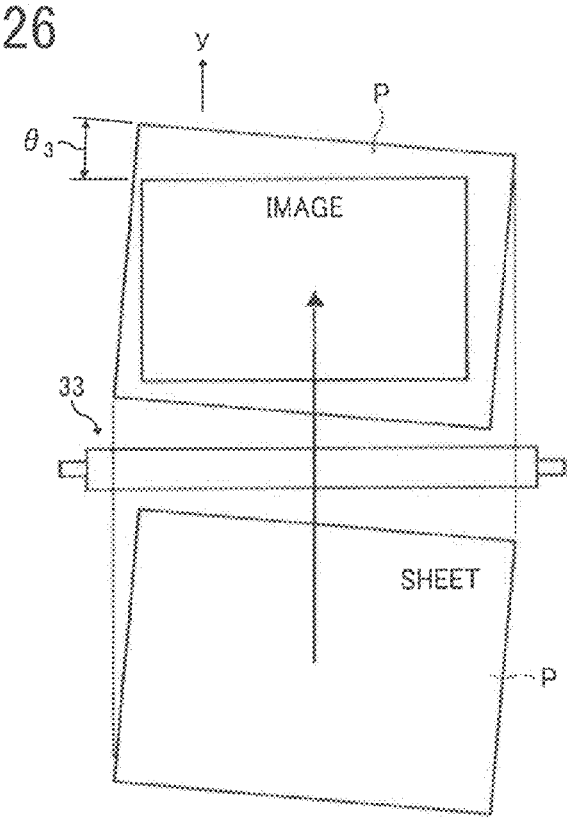
FIG. 26 is a schematic of the relationship between rotational skew of the recording paper generated upstream of the pair of registration rollers in the conveying direction, and image skew.

FIG. 26 is a schematic of the relationship between rotational skew of the recording paper P generated upstream of the pair of registration rollers 33 in the conveying direction, and image skew. In the state in FIG. 26, the recording paper P is not skewed at the position of the pair of registration rollers 33, and the recording paper P is conveyed straight along the conveying direction (y direction). However, the position of the recording paper P is inclined to the conveying direction, due to the rotational skew occurred at the upstream of the pair of registration rollers 33. Accordingly, image skew, as shown in FIG. 26, occurs at the secondary transfer nip. In other words, image skew occurs by the rotational skew of the recording paper P occurred at the position upstream of the pair of registration rollers 33, as well as by the skew of the recording paper P occurred at the position of the pair of registration rollers 33. Consequently, the generation of image skew cannot be effectively prevented, by just prompting the user to replace the pair of registration rollers 33, by predicting the end of life of the pair of registration rollers 33 at an early stage. As a result, in the present copier, skew of the recording paper P is detected, by providing an optical displacement sensor also in the white paper supply device placed at the upstream of the pair of registration rollers 33 in the conveying direction.

Figure 27:
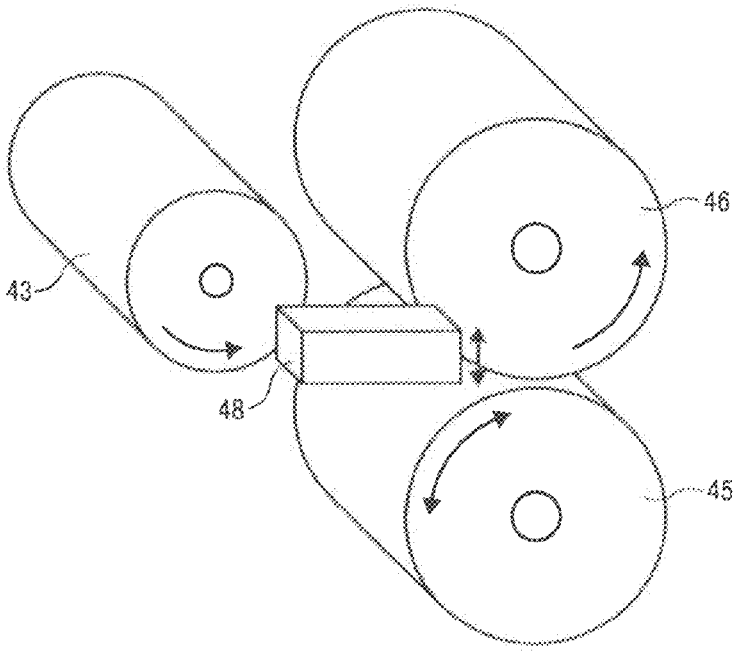
FIG. 27 is an enlarged perspective view of a feeding roller and the peripheral structure in a white paper supply device.

FIG. 27 is an enlarged perspective view of the feeding roller 43 and the peripheral structure in the white paper supply device. Due to the rotation drive of the feeding roller 43, the recording paper P fed out from a paper feed cassette, which is not shown, enters a conveying/separating nip formed by bringing the conveying roller 46 and the separation roller 45 in contact with each other. An optical displacement sensor 48 is arranged between the conveying/separating nip and the feeding roller 43. The main body controlling unit calculates a gradient index value based on the output from the optical displacement sensor 48, and based on the calculation result, detects the rotational skew due to the deterioration of the feeding roller 43.

The optical displacement sensor 48 is so arranged that the angle $\theta$ is set to 45°, to the conveying direction (y direction) of the recording paper P. The main body controlling unit calculates at least one of the gradient index value A, "tan ϕ", "sin ϕ−cos ϕ", and "sin ϕ", as a gradient value of the recording paper P. Instead of the gradient index value, the displacement in the x direction may be calculated as a movement index value.

A guide plate, which is not shown, used as a guiding unit is arranged between the conveying/separating nip and the feeding roller 43, as well as the optical displacement sensor 48. The guide plate guides the recording paper P fed out from the feeding roller 43, so as to bring the recording paper P in contact with a detection surface of the optical displacement sensor 48. Accordingly, the recording paper P enters the conveying/separating nip, while sliding with the optical displacement sensor 48. By bringing the recording paper P in contact with the optical displacement sensor 48, the displacement of the recording paper P can be detected without fail, even if an optical displacement sensor having a short detectable distance is used for the optical displacement sensor 48.

The optical displacement sensor 48 is movably supported by a supporting unit, which is not shown, in the thickness direction of the recording paper P. When the recording paper P is not fed out from the feeding roller 43, the optical displacement sensor 48 is stopped at the lower limit position in the movable range, by the weight of the optical displacement sensor 48. At this state, the optical displacement sensor 48 comes closest to a virtual straight line conveying path that connects a paper feeding-out position of the feeding roller 43 and the conveying/separating nip with a straight line. Normally, the recording paper P is conveyed along the virtual straight line conveying path. However, in the present copier, to bring the recording paper P in contact with the optical displacement sensor 48, the recording paper P is diverted from the virtual straight line conveying path by the guide plate, and guided towards the optical displacement sensor 48. When the recording paper P is in contact with the optical displacement sensor 48, the optical displacement sensor 48 is moved slightly upward from the lower end of the movable range. By moving the optical displacement sensor 48 in this manner, it is possible to prevent the leading edge of the paper from being caught by the sensor, when the leading edge of the recording paper P is brought in contact with the sensor.

Figure 28:
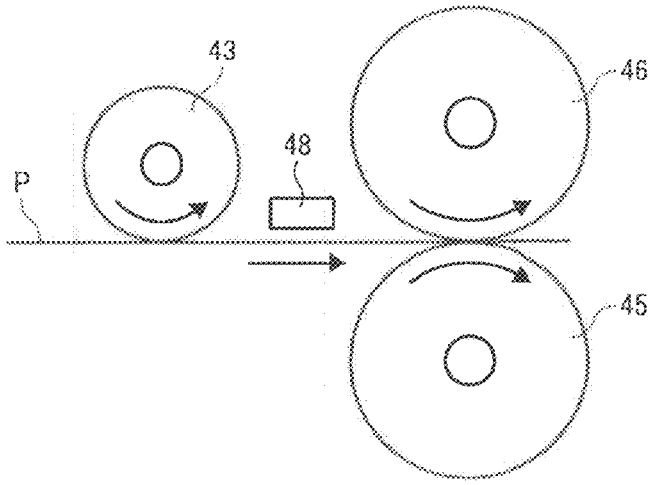
FIG. 28 is an enlarged schematic of a state in which only one recording paper is fed out from the feeding roller.

FIG. 28 is an enlarged schematic of a state in which only one recording paper P is fed out from the feeding roller 43. At the side of the feeding roller 43, as described above, the conveying/separating nip is formed by bringing the conveying roller 46 and the separation roller 45 in contact with each other. The conveying roller 46 is rotationally driven by a driving unit, which is not shown, in the anti-clockwise direction in FIG. 28. The conveying roller 46 then applies conveying force in the conveying direction to the recording paper P nipped at the conveying/separating nip. Alternatively, the separation roller 45 is rotationally driven by the rotation drive force of the conveying roller 46 at the state in which the recording paper P is not nipped at the conveying/separating nip. As shown in FIG. 28, when only one recording paper P fed out from the feeding roller 43 is nipped at the conveying/separating nip, the separation roller 45 is rotationally driven by the movement of the recording paper P.

Figure 29:
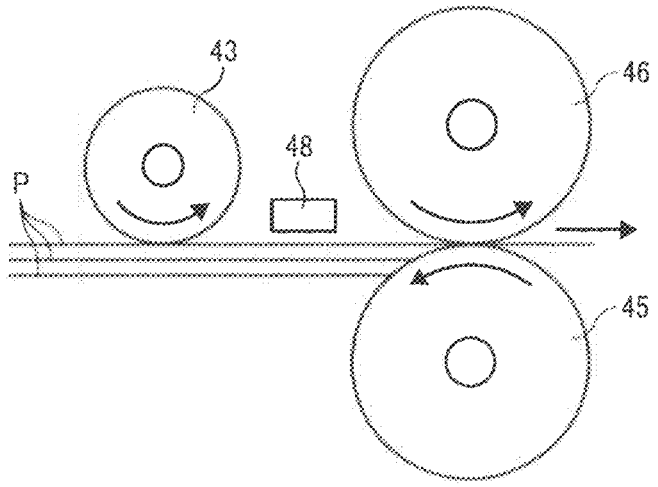
FIG. 29 is an enlarged schematic of a state in which a plurality of recording papers is fed out from the feeding roller in an overlapping state.

FIG. 29 is an enlarged schematic of a state in which a plurality of recording papers P is fed out from the feeding roller 43 in an overlapping state. Such a state is called a double feed. When the double feed occurs, the recording papers P enter the conveying/separating nip in an overlapping state. Accordingly, rotation torque of the separation roller 45 increases sharply, thereby operating a torque limiter. The rotation drive force of the drive motor is transferred to the separation roller 45, thereby rotationally driving the separation roller 45 in the anti-clockwise direction in FIG. 29. Consequently, the conveying force in the direction opposite from the conveying direction is applied to the lowermost recording paper P, thereby separating from the uppermost recording paper P. The operation is continued until only the uppermost recording paper P is remained.

Because paper jams frequently occur at a region near the separation roller 45 that separates the recording papers P one by one in this manner, a paper detection sensor is generally provided near the separation roller 45. In the present copier, the optical displacement sensor 48 is commonly used as the paper detection sensor. Accordingly, it is possible to reduce cost.

Figure 30:
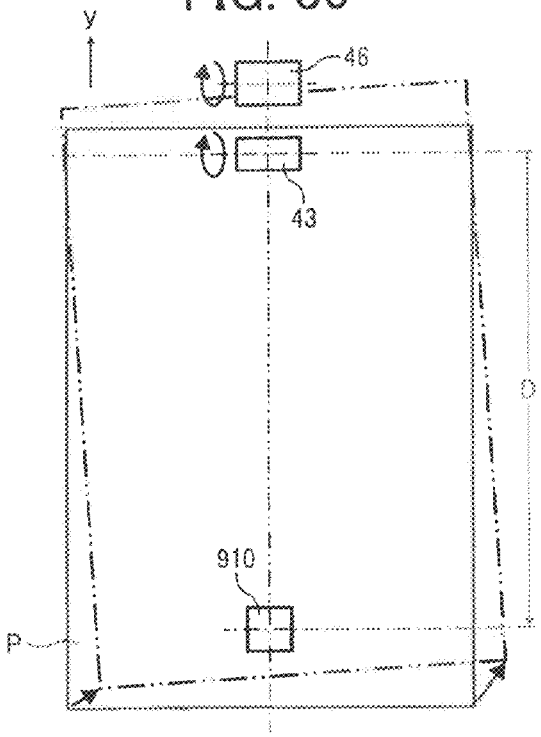
FIG. 30 is a schematic of a first configuration example in which an optical displacement sensor 910 detects the displacement of a recording paper P in a paper feed cassette.
Figure 31:
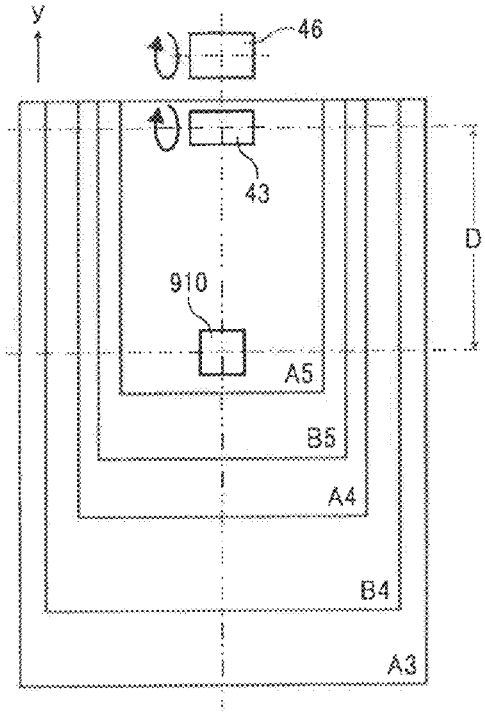
FIG. 31 is a schematic of a second configuration example in which the optical displacement sensor 910 detects the displacement of the recording paper P in the paper feed cassette.

FIG. 30 is a schematic of a configuration example in which the optical displacement sensor 910 detects the displacement of a recording paper P in a paper feed cassette, as the image forming apparatus disclosed in Japanese Patent Application Laid-open No. 2005-41623. As long as the user sets the recording paper P correctly, the position of the recording paper P in the paper feed cassette does not largely incline from the conveying direction (y direction). Due to the deterioration of the feeding roller 43, when the feeding roller 43 comes into contact with the recording paper P in the cassette with uneven pressure, the recording paper P is fed out from the cassette, while being rotated and skewed (dashed-dotted line). At this time, the recording paper P basically moves in an arc around the feeding roller 43. Accordingly, the rotational displacement of the recording paper P is increased towards the rear edge of the paper. Consequently, to increase the detection sensitivity of skew, it is preferable to arrange the optical displacement sensor 910 far from the feeding roller 43 as much as possible. In other words, it is preferable to increase the distance D as much as possible. However, the recording papers P of various sizes are set in the paper feed cassette. Therefore, as shown in FIG. 31, the distance D needs to be set to a small value, corresponding to the standard size of the smallest paper (A5 in FIG. 31). As a result, it is difficult to sensitively detect the rotational skew.

Figure 32:
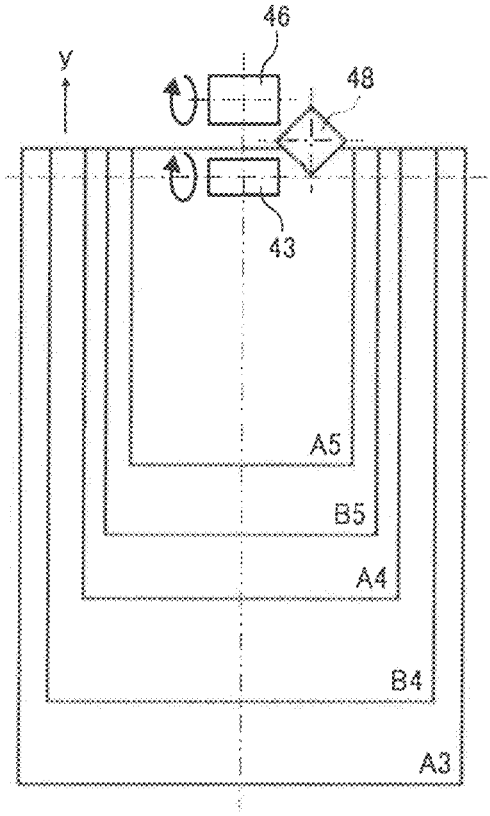
FIG. 32 is a schematic of the relationship between the paper feed cassette and the optical displacement sensor of the copier.

Alternatively, in the present copier, as shown in FIG. 32, the skew of the recording paper P between the feeding roller 43 and the conveying roller 46 is detected, instead of the recording paper P in the paper feed cassette. In such a configuration, regardless of the size of the recording paper P, the maximum displacement of the rear edge of the paper due to skew, can be detected. Accordingly, it is possible to detect skew with high sensitivity.

Figure 33:
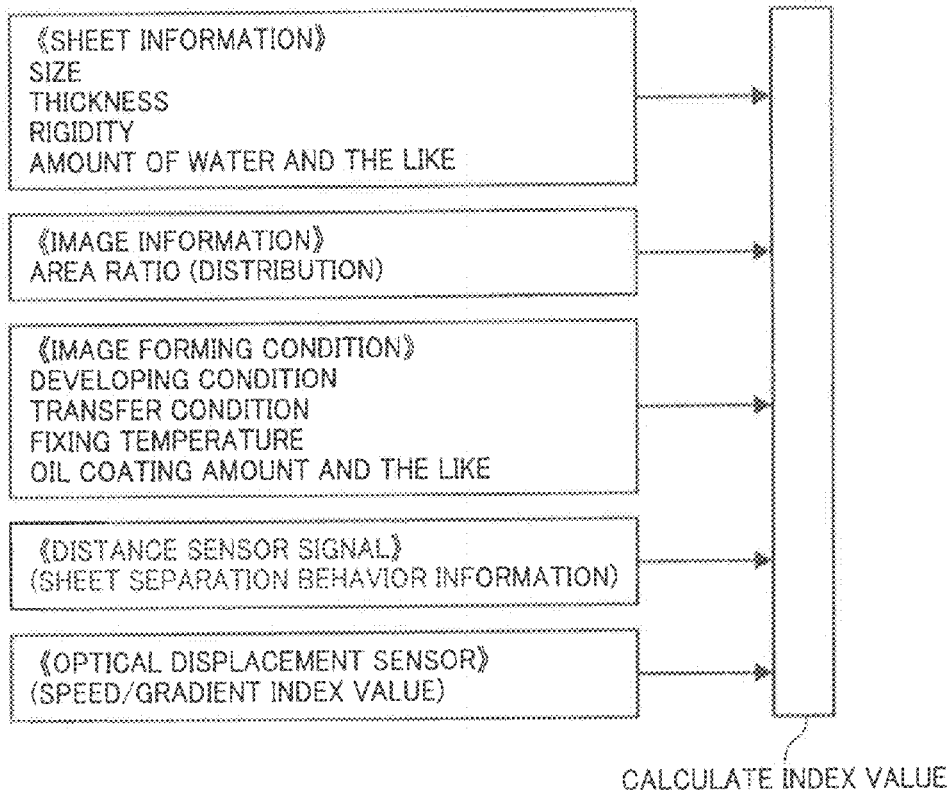
FIG. 33 is a schematic for explaining a calculating step of a life index value used for predicting the end of life.

FIG. 33 is a schematic for explaining a calculating step of a life index value used for predicting the end of life of the pair of registration rollers 33, the stretching roller, and the feeding roller 43, based on the gradient index value. The main body controlling unit does not directly use the gradient index value to predict the end of life, but calculates a life index value used for predicting the end of life of the roller, which is an object whose end of life is to be detected, based on the gradient index value. Information used for calculating the life index value is sheet information, image information, an image forming condition, a distance sensor signal, and the like, as well as the gradient index value. The distance sensor signal reflects the detachability of the sheet fed out from the roller from the roller surface, and indicates the distance between a distance sensor at the exit of the nip and the sheet. The life index value, for example, may be a Mahalanobis distance of a Mahalanobis Taguchi system (MTS) method (refer to Japanese Standards Association Publication "Technical Developments in the MT system").

To calculate the life index value, multi-dimensional data including various pieces of information shown in FIG. 33 is used. A multi-dimensional space in which coordinate axes different from one another is set for each information, and the distance in the multi-dimensional space is calculated. The distance is a life index value D. By adopting the life index value D, the presence of breakdown after a predetermined period of time and an image rank can be determined. The period until a failure actually takes place (risk is increased) is the time left.

The information used for calculating the life index value D may be specified as the following. In other words, a life index value D is calculated based on all types of information. The life index value D is then calculated by excluding only one piece of the information. The life index value D excluding a piece of information from all the types of information is calculated, while subsequently changing the information being excluded. The life index value D obtained by using all the types of information, and the life index value D obtained by excluding a piece of information are compared, respectively. The type of information that relatively increases the life index value D (information with a large contribution ratio for predicting life) is then selected. The life index value D is then calculated only by the selected information. The method is only an example, and the life index value D may be calculated, by using an orthogonal table of a two-level system and combining the items. The orthogonal table is a "combination table of conditions" used for experimental design and the like, and is a tool for reducing the number of experiments and for obtaining the stable result for noise. For example, if there are five types of parameters with three levels each, 35=243 ways of experiments need to be normally carried out to obtain the optimal condition. However, by using the orthogonal table, the number of experiments can be reduced. Because noise information is equally included in each experiment, it is possible to obtain the stable result (high reproducibility). In this case, the orthogonal table is used to extract a parameter (cause item) that brought change, when the index value is changed corresponding to the change of state, in a practical operation, or alternatively, the orthogonal table is used to extract an unnecessary parameter that does not affect the change in the index value, in a developing experiment. By using the orthogonal table, compared to a round-robin calculation method, the number of calculation can be advantageously reduced while obtaining the stable result. With the above-described procedure, the prediction of failure to the determination of treatment is executed.

Figure 34:
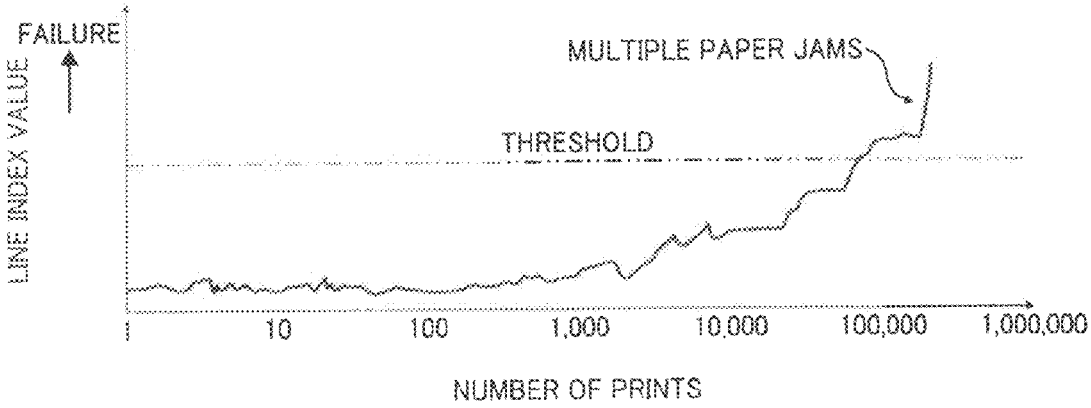
FIG. 34 is a graph of a life index value D changed over the time.

FIG. 34 is a graph of the life index value D changed over the time. The life index value D is increased with the number being printed. Accordingly, thresholds to indicate the deterioration of parts in which paper jams and skews frequently occur over the time are provided, and a request to replace the parts is notified, when the thresholds are exceeded. The thresholds are determined based on the condition of the sheet used by the user, image ratio, and the like. When a unit for correcting the conveying speed and the skew generated over the time is included, the correction operation may be carried out before the threshold is reached.

Figure 35:
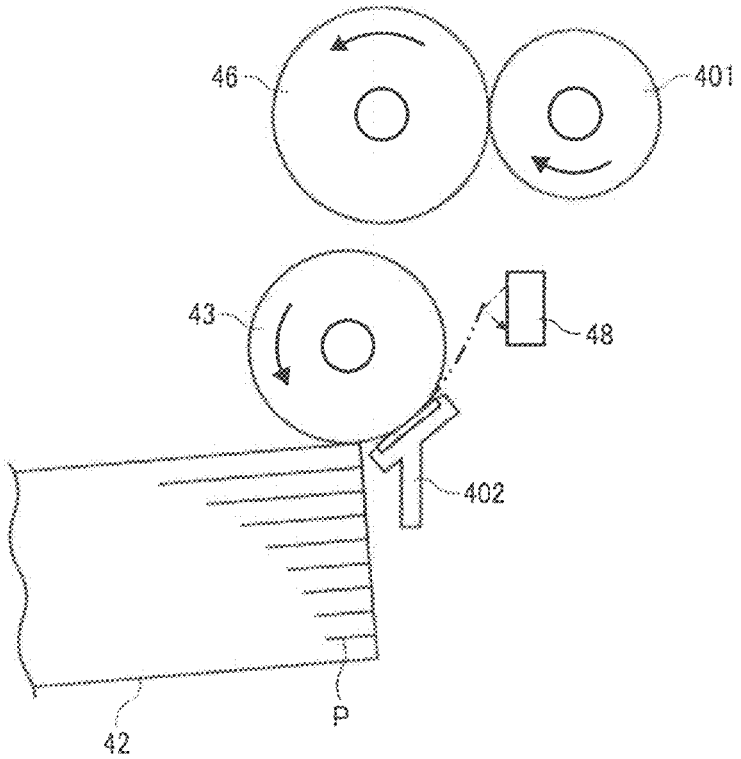
FIG. 35 is an enlarged schematic of a paper feed cassette and the peripheral structure of a copier according to a first modification.

FIG. 35 is an enlarged schematic of a paper feed cassette of a copier and the peripheral structure according to a first modification. In the copier according to the first modification, the recording papers P fed out from the feeding roller 43 are separated one by one, by using a separation pad 402, instead of the separation roller. Compared to the configuration in which the separation roller is used, a paper jam does not occur easily in the configuration. According to the layout, the diameter of the conveying roller 46 can be increased. Consequently, it is possible to increase the distance between the feeding roller 43 and the conveying roller 46, and the skew due to the feeding roller 43 can be generated more significantly between the feeding roller 43 and the conveying roller 46.

Figure 36:
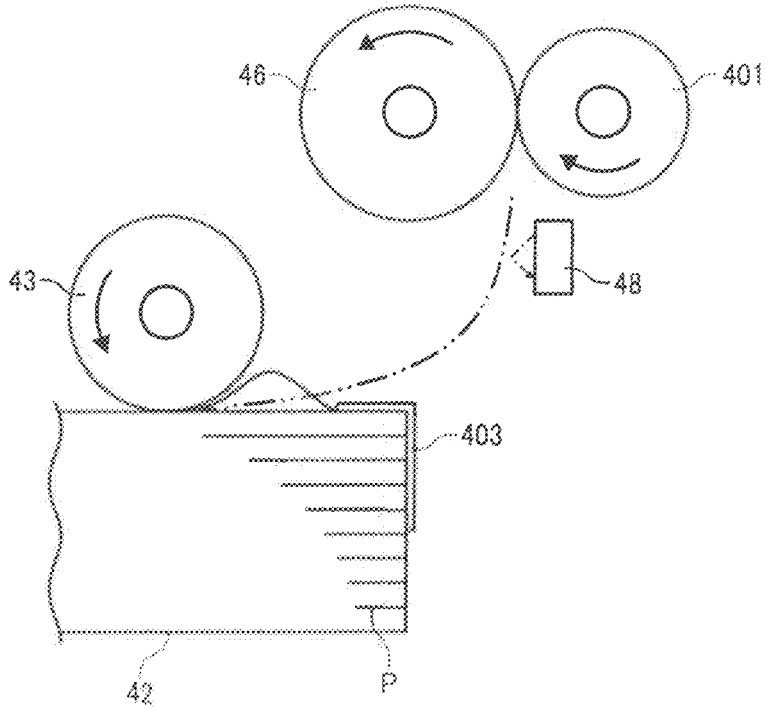
FIG. 36 is an enlarged schematic of a paper feed cassette and the peripheral structure of a copier according to a second modification.

FIG. 36 is an enlarged schematic of a paper feed cassette and the peripheral structure of a copier according to a second modification. In the copier, the recording papers P are separated one by one, by feeding the recording paper P from the paper feed cassette, while hooking and bending the recording paper P at a corner clip 403 provided at the corner of the paper feed cassette 42. In other words, the corner clip 403 functions as a separating unit. In the configuration, similar to the first modification, it is possible to increase the distance between the feeding roller 43 and the conveying roller 46, and the skew due to the feeding roller 43 can be generated more significantly between the feeding roller 43 and the conveying roller 46.

An example of the copier that forms a full color image by a so-called tandem method has been described. However, the present invention may also be applied to an image forming apparatus that only forms a single-color image and an image forming apparatus that forms a multi-color image by a method different from the tandem method.

The white paper supply device 40 of the copier according to the embodiment includes the paper feed cassette 42 that is a sheet accommodating unit to accommodate a plurality of recording papers P in an overlapping state. The white paper supply device 40 also includes the feeding roller 43 that feeds the recording papers P in the cassette to the paper feed path 44, which is a conveying path, by rotating in a state in contact with the uppermost recording paper P of the recording papers P accommodated in the paper feed cassette 42. In the white paper supply device 40, the optical displacement sensor 48 is arranged, so as to detect the displacement of the recording paper P fed out from the feeding roller 43. In such a configuration, the life expectancy of the feeding roller 43 can be determined, by detecting the skew of the recording paper P due to deterioration of the feeding roller 43, by which the skew is likely to occur.

In the copiers according to the first modification and the second modification, the separation pad 402 and the corner clip 403 are provided to separate the recording papers P fed out by the feeding roller 43 one by one, so as not to overlap with each other. The optical displacement sensor 48 is arranged, so as to detect the displacement of the recording paper P, after being separated by the separation pad 402 and the corner clip 403. In such a configuration, as already described earlier, it is possible to increase the distance between the feeding roller 43 and the conveying roller 46, and the skew due to the feeding roller 43 can be generated more significantly between the feeding roller 43 and the conveying roller 46.

In the white paper supply device 40 of the copier according to the embodiment, the guide plate, which is a guiding unit, is provided so as to bring the recording paper P in contact with the optical displacement sensor 48 at the position opposite to the optical displacement sensor 48. Accordingly, even if an optical displacement sensor having a short detectable distance is used for the optical displacement sensor, it is possible to detect the displacement of the recording paper P without fail.

In the copier according to the embodiment, a sensor that detects the displacement of the sheet-like member at a predetermined period and outputs the signal is used for the optical displacement sensors 38 and 48, the registration sensor 65 formed of an optical displacement sensor, and the belt speed detection sensor 39 (hereinafter, simply referred to as "optical displacement sensors"). The controller or the controlling unit as a calculating unit is formed, so as to calculate the average displacement within a predetermined period of time (time required to sample 20 times) of the sheet-like member based on the outputs from the sensors, and calculate the gradient index value as a movement index value, based on the average displacement. In such a configuration, as already described earlier, the sensor outputs may be converted into the average displacement of a stable value.

In the copier according to the embodiment, the controller and the controlling unit are formed, so as to identify the presence of the sheet-like member at the position opposite to the optical displacement sensor, based on the change of the outputs from the optical displacement sensor. Such a configuration can reduce the cost, by commonly using the optical displacement sensor as the sheet-like member detection sensor.

In the copier according to the embodiment, the optical displacement sensor is arranged at the position in which the vertical alignment direction and the horizontal alignment direction of the light receiving elements of the imaging module 912 are inclined by 45°, to the conveying direction. In such a configuration, as aforementioned in FIGS. 16 and 17, the skew of the sheet-like member can be sensitively detected, compared to when the angle θ is set to an angle different from 45°.

In the copier according to the embodiment, the conveying roller 46 used as a conveying force applying unit that applies the conveying force in the conveying direction to the recording paper P in the conveying path, and the pair of registration rollers 33 are aligned in the conveying direction. The optical displacement sensor is arranged at the region near each of the rollers, and the main body controlling unit as a calculating unit is formed, so as to individually calculate the gradient index value near each of the rollers, based on the result detected by the optical displacement sensor. In such a configuration, the skew of the recording paper P generated at the position of each of the rollers can be individually detected.

In the copier according to the embodiment, the controller or the controlling unit as a calculating unit is formed, so as to calculate the gradient index value indicating the inclination of the sheet-like member to the conveying direction in the moving direction, as a movement index value, based on the result detected by the optical displacement sensor. In such a configuration, it is possible to identify the generation of skew of the sheet-like member, based on the gradient index value.

In the copier according to the embodiment, when the controller or the controlling unit is formed, so as to calculate "sin $\phi$−cos $\phi$" as a gradient index value, based on the difference between the displacement in the β direction (vertical alignment direction of the light receiving elements) and the displacement in the α direction (horizontal alignment direction of the light receiving elements), both detected by the optical displacement sensor, as already described earlier, the skew angle $\phi$ of the sheet-like member can be detected highly accurately.

As indicated by Equation (3), the result in which the difference between the displacement in the α direction and the displacement in the β direction is divided by a synthetic displacement, is calculated as the gradient index value A, as already described earlier, the skew angle $\phi$ can be detected separately from the speed, by standardizing to eliminate the influence of speed by division.

When "tan $\phi$", which is a gradient index value, is calculated based on the ratio between the displacement in the α direction and the displacement in the β direction, as already described earlier, the skew of the sheet-like member can be detected highly accurately.

Figure 1:
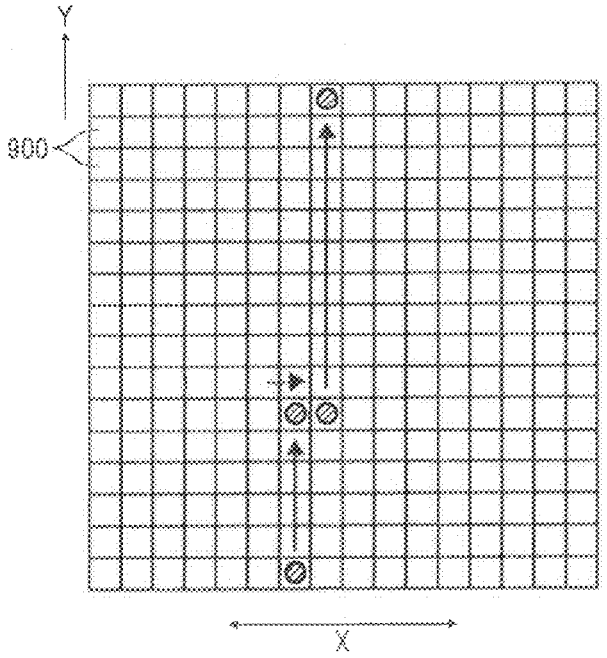
FIG. 1 is a schematic of a matrix of light receiving elements of a conventional optical displacement sensor.
Figure 2:
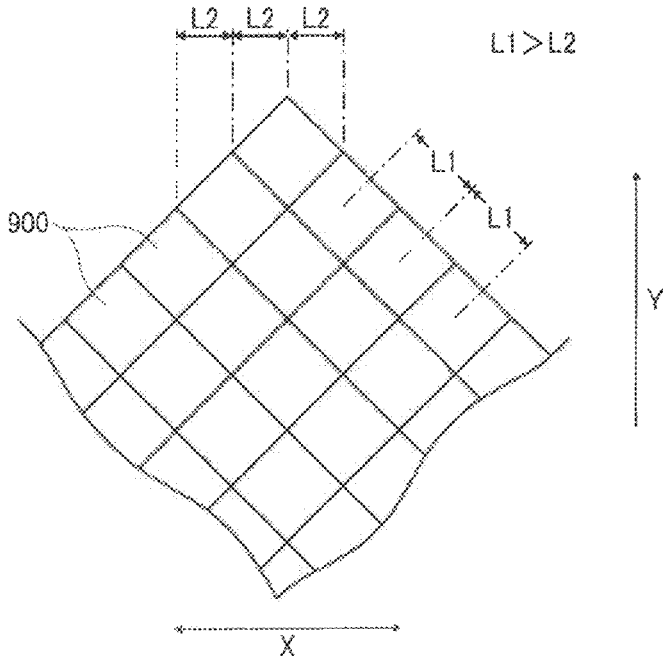
FIG. 2 is a schematic of an example in which the matrix is arranged in a tilted position to the conveying direction of an object to be detected.

In the inventions, the orthogonal moving distance of the object to be detected can be detected by a unit less than a pixel of the optical displacement sensor, by so arranging the optical displacement sensor that the vertical alignment direction and the horizontal alignment direction of the light receiving elements in the matrix are tilted to the conveying direction of the sheet-like member and the belt member, which are objects to be detected. For example, if the vertical alignment direction and the horizontal alignment direction of the light receiving elements in the matrix are inclined, to the conveying direction of the sheet-like member, as shown in FIG. 2. In FIG. 2, the direction in the arrow Y indicates the conveying direction of the sheet-like member. When the vertical alignment direction and the horizontal alignment direction in the matrix are inclined to the direction of the arrow Y, as shown in FIG. 2, each of the light receiving elements 900 aligns in a pitch narrower (L2 in FIG. 2) than a pixel in the matrix (L1 in FIG. 2), along the direction of the arrow X perpendicular to the direction of the arrow Y. Accordingly, the moving distance of the sheet-like member in the direction of the arrow X can be detected by a unit less than a pixel. In this manner, by detecting the moving distance of the object to be detected in the direction of the arrow X by a unit narrower than a pixel in the matrix, it is possible to detect more sensitively than before.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying apparatus comprising:

a conveying path that conveys a sheet-like member;

an optical displacement sensor that detects displacement of the sheet-like member based on a result obtained by detecting a light emitted from a light emitting element and reflected on a surface of the sheet-like member in the conveying path using a plurality of light receiving elements arranged in a matrix array; and a calculating unit that calculates a movement index value indicating moving distances of the sheet-like member in a conveying direction and in a direction perpendicular to the conveying direction based on an output from the optical displacement sensor, wherein the optical displacement sensor is provided in such a manner that a row alignment direction and a column alignment direction of the light receiving elements in the matrix array are tilted by 45 degrees with respect to the conveying direction.

2. The sheet conveying apparatus according to claim 1, further comprising:

a sheet accommodating unit that accommodates a stack of a plurality of sheet-like members; and a feeding roller that feeds the sheet-like members in the sheet accommodating unit one by one to the conveying path by rotating in a state in contact with a top sheet-like member in the sheet accommodating unit, wherein the optical displacement sensor is arranged to detect displacement of the sheet-like member fed by the feeding roller.

3. The sheet conveying apparatus according to claim 1, further comprising:

a sheet accommodating unit that accommodates a stack of a plurality of sheet-like members;

a feeding roller that feeds the sheet-like members in the sheet accommodating unit one by one to the conveying path by rotating in a state in contact with a top sheet-like member in the sheet accommodating unit; and a separation unit that separates the sheet-like members fed by the feeding roller one by one, wherein the optical displacement sensor is arranged to detect displacement of the sheet-like member that is separated by the separation unit.

4. The sheet conveying apparatus according to claim 1, further comprising a guiding unit that guides the sheet-like member to bring it into contact with the optical displacement sensor at a position facing the optical displacement sensor.

5. The sheet conveying apparatus according to claim 1, wherein the optical displacement sensor detects the displacement of the sheet-like member and outputs a detection signal in a predetermined period, and the calculating unit calculates an average displacement of the sheet-like member within the predetermined period based on the detection signal, and calculates the movement index value based on the average displacement.

6. The sheet conveying apparatus according to claim 1, further comprising a sheet presence detecting unit that detects presence of a sheet-like member at a position facing the optical displacement sensor based on a change of the output from the optical displacement sensor.

7. The sheet conveying apparatus according to claim 1, further comprising a plurality of conveying force applying units each applying conveying force in the conveying direction to the sheet-like member in the conveying path, being arranged in the conveying direction, wherein the optical displacement sensor is arranged near each of the conveying force applying units, and the calculating unit individually calculates a movement index value near each of the conveying force applying units based on the output from the optical displacement sensor.

8. The sheet conveying apparatus according to claim 7, further comprising a life predicting unit that predicts life expectancy of the conveying force applying units based on the movement index value.

9. An image reading apparatus comprising:

a sheet conveying apparatus that conveys an original sheet that is a sheet-like member; and a reading unit that reads an image formed on the original sheet being conveyed by the sheet conveying apparatus or conveyed to a predetermined reading position by the sheet conveying apparatus, wherein the sheet conveying apparatus is the sheet conveying apparatus according to claim 1.

10. The image reading apparatus according to claim 9, further comprising a correcting unit that corrects image information read by the reading unit based on the movement index value.

11. An image forming apparatus comprising:

a sheet conveying apparatus that conveys a recording sheet that is a sheet-like member; and an image forming unit that forms an image on the recording sheet conveyed by the sheet conveying apparatus, wherein the sheet conveying apparatus is the sheet conveying apparatus according to claim 1.

12. The sheet conveying apparatus according to claim 1, wherein the optical displacement sensor detects fine irregularities on the surface of the sheet-like member.

13. A sheet conveying apparatus comprising:

a conveying path that conveys a sheet-like member;

an optical displacement sensor that detects displacement of the sheet-like member based on a result obtained by detecting a light emitted from a light emitting element and reflected on a surface of the sheet-like member in the conveying path using a plurality of light receiving elements arranged in a matrix array; and a calculating unit that calculates a movement index value indicating moving distances of the sheet-like member in a conveying direction and in a direction perpendicular to the conveying direction based on an output from the optical displacement sensor, and the calculating unit calculates a gradient index value that indicates an inclination of the sheet-like member with respect to the conveying direction as the movement index value, wherein the optical displacement sensor is provided in such a manner that a row alignment direction and a column alignment direction of the light receiving elements in the matrix array are tilted with respect to the conveying direction.

14. The sheet conveying apparatus according to claim 13, wherein the calculating unit calculates the gradient index value based on a difference between displacements of the sheet-like member in the row alignment direction and the column alignment direction detected by the optical displacement sensor.

15. The sheet conveying apparatus according to claim 14, wherein the calculating unit outputs a result obtained by dividing the difference between the displacements in the row alignment direction and the column alignment direction by a sum of the displacements as the gradient index value.

16. The sheet conveying apparatus according to claim 13, wherein the calculating unit calculates the gradient index value based on a ratio of displacements of the sheet-like member in the row alignment direction and the column alignment direction detected by the optical displacement sensor.

* * * * *